US006552703B1

(12) United States Patent
Ushigusa

(10) Patent No.: US 6,552,703 B1
(45) Date of Patent: Apr. 22, 2003

(54) DISPLAY APPARATUS OF CAPACITIVE LIGHT EMITTING DEVICES

(75) Inventor: Yoshihiro Ushigusa, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/517,721

(22) Filed: Mar. 2, 2000

(30) Foreign Application Priority Data

Mar. 4, 1999 (JP) ..... 11-057571

(51) Int. Cl.[7] ..... G09G 3/30; G09G 3/34
(52) U.S. Cl. ..... 345/77; 345/76; 345/84
(58) Field of Search ..... 345/76–77, 84, 345/82

(56) References Cited

U.S. PATENT DOCUMENTS 4,193,095 A * 3/1980 Mizushima ..... 345/77
4,652,872 A * 3/1987 Fujita ..... 345/78
4,823,121 A * 4/1989 Sakamoto et al. ..... 345/78
5,844,368 A * 12/1998 Okuda et al. ..... 315/169.1
6,191,764 B1 * 2/2001 Kono et al. ..... 345/76
6,222,323 B1 * 4/2001 Yamashita et al. ..... 315/169.3

* cited by examiner

*Primary Examiner*—Richard Hjerpe
*Assistant Examiner*—Duc Q. Dinh
(74) *Attorney, Agent, or Firm*—Morgan, Lewis & Bockius LLP

(57) ABSTRACT

A display apparatus using capacitive light emitting devices, in which some of a plurality of driving lines are selected in a scanning period in predetermined cyclic period consisting of the scanning period and a resetting period subsequent thereto, current sources are connected to the selected driving lines, and a current in the forward direction is supplied to each of the capacitive light emitting devices between the selected driving lines and a selected one scanning line, and in the resetting period, a same electric potential is applied to driving lines to be selected for a next scanning period and all of the plurality of scanning lines, thereby discharging charges of the capacitive light emitting devices between the driving lines to be selected and all of the scanning lines, wherein a length of the scanning period in the predetermined cyclic period is changed in response to a luminance information command, and the period other than the scanning period in the predetermined cyclic period is set to the resetting period.

7 Claims, 22 Drawing Sheets

DISPLAY APPARATUS OF CAPACITIVE LIGHT EMITTING DEVICES

BACKGROUND OF THE INVENTION

1. Field of the Invention

The invention relates to a display apparatus using capacitive light emitting devices such as organic electroluminescence devices or the like and its driving method.

2. Description of the Related Art

As a display in which an electric power consumption is low and a display quality is high and, further, a thin size can be realized, an electroluminescence display constructed by arranging a plurality of organic electroluminescence devices in a matrix shape is highlighted. As shown in FIG. 1, the organic electroluminescence device is constructed in a manner such that an organic function layer 102 of at least one layer consisting of an electron transporting layer, a light emitting layer, a hole transporting layer, or the like and a metal electrode 103 are laminated on a transparent substrate 100 made of a glass substrate or the like on which a transparent electrode 101 is formed. When a plus voltage is applied to an anode of the transparent electrode 101 and a minus voltage is applied to a cathode of the metal electrode 103, namely, when a direct current is applied across the transparent electrode and the metal electrode, the organic function layer 102 emits light. An organic compound in which good light emitting characteristics can be expected is used as an organic function layer, thereby enabling the electroluminescence display to endure a practical use.

The organic electroluminescence device (hereinafter, simply referred to as a device) can be electrically expressed by an equivalent circuit as shown in FIG. 2. As will be understood from the diagram, the device can be replaced with a construction comprising a capacitance component C and a component E of characteristics of a diode connected in parallel to the capacitance component. The organic electroluminescence device is, therefore, regarded as a capacitive light emitting device. According to the organic electroluminescence device, when a DC light emission driving voltage is applied across the electrodes, charges are stored in the capacitance component C. Subsequently, when the applied voltage exceeds a barrier voltage or a light emission threshold voltage that is peculiar to the device, a current starts on flowing to the organic function layer serving as a light emitting layer from the electrode (anode side of the diode component E) and the device emits the light at an intensity which is proportional to the current.

The characteristics of a voltage V—a current I—a luminance L of the device are similar to those of the diode as shown in FIG. 3. When the device is supplied with a voltage of a light emission threshold value Vth or less, the current I is extremely small. When the voltage exceeds the light emission threshold value Vth, the current I suddenly increases. The current I is almost proportional to the luminance L. According to the device, if a driving voltage exceeding the light emission threshold value Vth is applied to the device, the light emission luminance proportional to the current according to the driving voltage is provided. If the driving voltage applied is equal to or less than the light emission threshold value Vth, no driving current flows and the light emission luminance is equal to zero.

A simple matrix driving system can be applied as a driving method of a display panel using a plurality of organic electroluminescence devices. FIG. 4 shows a structure of an example of a simple matrix display panel. n cathode lines (metal electrodes) $B_1$ to $B_n$ are extended and provided in parallel in the lateral direction and m anode lines (transparent electrodes) $A_1$ to $A_m$ are extended and provided in parallel in the vertical direction. Light emitting layers of organic electroluminescence devices $E_{1,1}$ to $E_{m,n}$ are sandwiched in (total n×m) crossing portions of the cathode lines and the anode lines. The devices $E_{1,1}$ to $E_{m,n}$ serving as pixels are arranged in a lattice shape. In correspondence to each crossing position of the anode lines $A_1$ to $A_m$ in the vertical direction and the cathode lines $B_1$ to $B_n$ in the horizontal direction, one end (anode line side of the diode component E of the equivalent circuit) is connected to the anode line and the other end (cathode line side of the diode component E of the equivalent circuit) is connected to the cathode line. The cathode lines are connected to a cathode line scanning circuit 1. The anode lines are connected to an anode line driving circuit 2.

The cathode line scanning circuit 1 has scan switches $\mathbf{5}_1$ to $\mathbf{5}_n$ corresponding to the cathode lines $B_1$ to $B_n$ in which an electric potential of each cathode line is individually determined. Each scan switch applies either an inverse bias potential $V_{cc}$ (for example, 10V) which is obtained from a power voltage or a ground potential (0V) to the corresponding cathode line.

The anode line driving circuit 2 has current sources $\mathbf{2}_1$ to $\mathbf{2}_m$ (for example, constant current sources) and drive switches $\mathbf{6}_1$ to $\mathbf{6}_m$ corresponding to the anode lines $A_1$ to $A_m$ for individually supplying a driving current to each device through each anode line and is constructed in a manner such that the drive switch is on/off controlled so as to individually supply a current to each anode line. A voltage source such as a constant voltage source can be also used as a driving source. A current source (power supplying circuit whose supply current amount is controlled so as to have a desired value) is generally used because of reasons such that voltage—luminance characteristics are unstable for a temperature change although the current—luminance characteristics are stable for a temperature change and the like. The supply current amount of each of the current sources $\mathbf{2}_1$ to $\mathbf{2}_m$ is set to a current amount that is necessary to maintain a state where the device emits the light at a desired instantaneous luminance (hereinafter, the state is referred to as a stationary light emitting state). When the device is in the stationary light emitting state, the charges corresponding to the supply current amount are stored in the capacitance component C of the device. Thus, a voltage across the device is equal to a specified value $V_e$ (hereinafter, referred to as a specified light emission voltage) corresponding to the instantaneous luminance.

The anode lines are also connected to an anode line resetting circuit 3. The anode line resetting circuit 3 has shunt switches $\mathbf{7}_1$ to $\mathbf{7}_m$ provided every anode line. When the shunt switch is selected, the corresponding anode line is set to a ground potential.

The cathode line scanning circuit 1, anode line driving circuit 2, and anode line resetting circuit 3 are connected to a light emission control circuit 4.

The light emission control circuit 4 controls the cathode line scanning circuit 1, anode line driving circuit 2, and anode line resetting circuit 3 in accordance with image data supplied from an image data generating system (not shown) so as to display an image shown by the image data. The light emission control circuit 4 generates a scanning line selection control signal to the cathode line scanning circuit 1 and controls so as to switch the scan switches $\mathbf{5}_1$ to $\mathbf{5}_n$ in a manner such that one of the cathode lines corresponding to a horizontal scanning period of the image data is selected and set to the ground potential and the inverse bias potential $V_{cc}$ is applied to the other cathode lines. The inverse bias potential $V_{cc}$ is applied by the constant voltage source connected to the cathode line in order to prevent that the device connected to the crossing point of the anode line which is at present being driven and the cathode line in which a scan selection is not performed emits light due to crosstalk. The inverse bias potential $V_{cc}$ is generally set so that $V_{cc}$=specified light emission voltage $V_e$. Since the scan switches $\mathbf{5}_1$ to $\mathbf{5}_n$ are sequentially switched to the ground potential every horizontal scanning period, the cathode line set to the ground potential functions as a scanning line which enables the device connected to the cathode line to emit light.

The anode line driving circuit 2 executes a light emission control to the scanning line. The light emission control circuit 4 generates a drive control signal (driving pulse) showing which one of the devices connected to the scanning line is allowed to emit light at which timing and how long in accordance with the pixel information shown by the image data and supplies it to the anode line driving circuit 2. In response to the drive control signal, the anode line driving circuit 2 on/off controls some of the drive switches $\mathbf{6}_1$ to $\mathbf{6}_m$ and supplies a driving current to the devices according to the pixel information through the anode lines $A_1$ to $A_m$. The device to which the driving current was supplied emits light in accordance with the pixel information.

The resetting operation of the anode line resetting circuit 3 is executed in response to the reset control signal from the light emission control circuit 4. The anode line resetting circuit 3 turns on any switches of the shunt switches $\mathbf{7}_1$ to $\mathbf{7}_m$ corresponding to the anode line as a reset target shown by the reset control signal and turns off the other shunt switches.

A driving method of performing the resetting operation to discharge the charges stored in each device arranged in the lattice shape just before the scanning lines in the simple matrix display panel (hereinafter, referred to as a reset driving method) as disclosed in JP-A-9-232074 filed by the same applicant as that of the present invention. The reset driving method intends to makes a timing for activating the light emission of the device when the scanning line is switched early. The reset driving method of the simple matrix display panel will be described with reference to FIGS. 4 to 6.

The operations shown in FIGS. 4 to 6, which will be explained hereinlater, relates to the case where after the cathode line $B_1$ was scanned and the devices $E_{1,1}$ and $E_{2,1}$ were lit on, the cathode line $B_2$ is scanned and the devices $E_{2,2}$ and $E_{3,2}$ are lit on as an example. For making the description easy, the lit-on device is shown by a diode symbol and the lit-off light emitting device is shown by a capacitor symbol. The inverse bias potential $V_{cc}$ which is applied to the cathode lines $B_1$ to $B_n$ is set to 10V that is the same as the specified light emission voltage $V_e$ of the device.

First, in FIG. 4, only the scan switch $\mathbf{5}_1$ is switched to the ground potential side of 0V and the cathode line $B_1$ is scanned. The inverse bias potential $V_{cc}$ is applied to the other cathode lines $B_2$ to $B_n$ by the scan switches $\mathbf{5}_2$ to $\mathbf{5}_n$. At the same time, the current sources $\mathbf{2}_1$ and $\mathbf{2}_2$ are connected to the anode lines $A_1$ and $A_2$ by the drive switches $\mathbf{6}_1$ and $\mathbf{6}_2$. The other anode lines $A_3$ to $A_m$ are switched to the ground potential side of 0V by the shunt switches $\mathbf{7}_3$ to $\mathbf{7}_m$. In the case of FIG. 4, therefore, only the devices $E_{1,1}$ and $E_{2,1}$ are biased in the forward direction, the driving current flows from the current sources $\mathbf{2}_1$ and $\mathbf{2}_2$ as shown by arrows, and only the devices $E_{1,1}$ and $E_{2,1}$ perform the light emission. In the state, each of the non-light emitting devices $E_{3,2}$ to $E_{m,n}$ shown by hatched capacitor symbols is charged to a polarity as shown in the diagram.

The following reset control is performed just before the scan is shifted from the stationary light emitting state shown in FIG. 4 to a next state where the devices $E_{2,2}$ and $E_{3,2}$ perform the light emission. That is, as shown in FIG. 5, all of the drive switches $\mathbf{6}_1$ to $\mathbf{6}_m$ are turned off, all of the scan switches $\mathbf{5}_1$ to $\mathbf{5}_n$ and all of the shunt switches $\mathbf{7}_1$ to $\mathbf{7}_m$ are switched to the ground potential side of 0V, and all of the anode lines $A_1$ to $A_m$ and the cathode lines $B_1$ to $B_n$ are once shunted to the ground potential side of 0V, thereby all-resetting them. When the all-resetting operation is performed, since all of the anode lines and the cathode lines are set to the same electric potential of 0V, the charges stored in each device are discharged along routes shown by arrows in the diagram and the stored charges of all devices are instantaneously extinguished.

After the stored charges of all devices are set to zero as mentioned above, only the scan switch $\mathbf{5}_2$ corresponding to the cathode line $B_2$ is subsequently switched to the 0V side as shown in FIG. 6 and the cathode line $B_2$ is scanned. At the same time, the drive switches $\mathbf{6}_2$ and $\mathbf{6}_3$ are closed, the current sources $\mathbf{2}_2$ and $\mathbf{2}_3$ are connected to the corresponding anode lines, the shunt switches $\mathbf{7}_1$ and $\mathbf{7}_4$ to $\mathbf{7}_m$ are turned on, and 0V is applied to the anode lines $A_1$ and $A_4$ to $A_m$.

As mentioned above, in the light emission control of the reset driving method, a scan mode serving as a period of time during which one of the cathode lines $B_1$ to $B_n$ is made active and a subsequent reset mode are repeated. The scan mode and the reset mode are executed every horizontal scanning period (1H) of the image data. Now, assuming that the control mode is directly shifted from the state of FIG. 4 to the state of FIG. 6 without performing the reset control, for example, the driving current which is supplied from the current source $\mathbf{2}_3$ not only flows into the device $E_{3,2}$ but also is expended to cancel the reverse direction charges (shown in FIG. 4) stored in the devices $E_{3,3}$ to $E_{3,n}$, so that it takes time to set the device $E_{3,2}$ into the stationary light emitting state (the voltage across the device $E_{3,2}$ to the specified light emission voltage $V_e$).

When the reset control is performed, however, since the potentials of the anode lines $A_2$ and $A_3$ are set to approximately $V_{cc}$ at a moment when the scan is switched to the scan of the cathode line $B_2$, the charging currents are supplied to the devices $E_{2,2}$ and $E_{3,2}$ to be subsequently lit on from not only the current sources $\mathbf{2}_2$ and $\mathbf{2}_3$ but also a plurality of routes from the constant voltage sources connected to the cathode lines $B_1$ and $B_3$ to $B_n$. A parasitic capacitance is charged by the charging currents, the voltage instantaneously reaches the specified light emission voltage $V_e$ and the device can be instantaneously shifted to the stationary light emitting state. After that, within the scanning period of the cathode line $B_2$, since an amount of current which is supplied from the current source as mentioned above is set to a current amount such that device can maintain the stationary light emitting state at the specified light emission voltage $V_e$, the currents which are supplied from the current sources $\mathbf{2}_2$ and $\mathbf{2}_3$ flow into only the devices $E_{2,2}$ and $E_{3,2}$ and all of them are expended for light emission. That is, the light emitting state shown in FIG. 6 is continued.

According to the conventional reset driving method as mentioned above, since all of the cathode lines and anode lines are once connected to 0V as a ground potential or the same electric potential of the inverse bias potential $V_{cc}$ and reset before the control mode is shifted to the light emission control of the next scanning line, when the scanning line is switched to the next scanning line, the charging time until the specified light emission voltage $V_e$ is shortened and the activating speed of the light emission of the device to perform the light emission on the switched scanning line can be made fast.

The voltage levels of the cathode lines and anode lines in the operations shown in FIGS. 4 to 6 are shown by a timing chart of FIG. 7. In a scanning period j, the voltage across each of the devices existing on the crossing points of the cathode line $B_1$ and anode lines $A_1$ and $A_2$ is set to an anode line voltage level $V_{AA}$ (equal to $V_e$ in FIGS. 4 to 6) and the light emission is performed at the luminance corresponding to the anode line voltage level $V_{AA}$. In a next scanning period j+1, the voltage across each of the devices existing on the crossing points of the cathode line $B_2$ and anode lines $A_2$ and $A_3$ is set to an anode line voltage level $V_{AA}$ (equal to $V_e$ in FIGS. 4 to 6) and the light emission is performed at the luminance corresponding to the anode line voltage level $V_{AA}$.

In the light emission display using the conventional reset driving method mentioned above, in the case of performing the luminance adjustment, a general luminance adjusting method of the matrix display is applied. That is, as shown in FIG. 7 there is a method whereby the level of the voltage across the device at the time of the light emission is set to a constant value (that is, the constant instantaneous luminance and constant driving current of the device) and a connecting time of a driving source to the anode line is changed within a range of the scanning period of time, thereby adjusting the light emission luminance of each device (pulse width modulating method).

That is, if a luminance gradation (dimmer) is applied in dependence on a length of the driving time within each scanning period, the scanning period j in FIG. 7 relates to the case of the dimmer of 100% in which the luminance is the maximum because the light emitting state is continued until the end of the period. The scanning period j+1 relates to the case of the dimmer of 50% because the light emitting state is continued until the time point of the half of the period. The scanning period j+2 relates to the case of the dimmer of 80% because the light emitting state is continued until the time point of 80% of the period.

Within the scanning period in the cases other than the dimmer of 100%, the grounding operation is performed as shown in FIG. 8 until the period is shifted to the resetting period after completion of the operation corresponding to a dimmer percentage shown in FIG. 4. That is, the drive switches $\mathbf{6}_1$ and $\mathbf{6}_2$ are turned off and, at the same time, all of the shunt switches $\mathbf{7}_1$ to $\mathbf{7}_m$ are switched to the ground potential side of 0V. All of the anode lines $A_1$ to $A_m$, consequently, are set to the ground potential. Since the cathode line $B_1$ is held to the ground potential, the charges stored in the devices $E_{1,1}$ and $E_{2,1}$ are discharged along routes as shown by arrows in the diagram. The stored charges of the devices $E_{1,1}$ and $E_{2,1}$ are instantaneously extinguished. Since the cathode lines $B_2$ to $B_n$ are held in a state where the inverse bias potential $V_{cc}$ was applied by the scan switches $\mathbf{5}_2$ to $\mathbf{5}_n$ in the state, each of the non-light emitting devices $E_{1,2}$ to $E_{1,n}$ $E_{2,2}$ to $E_{2,n}$, . . . , and $E_{m,2}$ to $E_{m,n}$ shown as hatched capacitor symbols in FIG. 8 is charged to a polarity as shown in the diagram or maintains the charging state by the polarity. When the resetting period comes after that, the operation shown in FIG. 5 is executed.

In the $B_1$ scanning period of the dimmer of 100%, as shown in FIG. 9A after the cathode line $B_1$ was scanned and the devices $E_{1,1}$ and $E_{2,1}$ were lit on, in the case where the scan is shifted to the cathode line $B_2$ in the resetting period and the next $B_2$ scanning period and the devices $E_{2,2}$ and $E_{3,2}$ are lit on, the emission of the charges of [2+(m−2)(n−1)]e occurs in the resetting period. The charging of the charges of [2+(m−2)(n−1)]e is performed in the $B_2$ scanning period. Now, assuming that m=4 for easy understanding, an emission amount of the charges in the resetting period is equal to 2ne and a charging amount of the charges in the $B_2$ scanning period is equal to 2ne.

In the $B_1$ scanning period of the dimmer of 50%, as shown in FIG. 9B the light emitting operation for scanning the cathode line $B_1$ and allowing the devices $E_{1,1}$ and $E_{2,1}$ to be lit on and the grounding operation to connect them to the ground by the shunt switches $\mathbf{7}_1$ to $\mathbf{7}_m$ as mentioned above are sequentially performed by an amount of 50% at a time. After that, the scan is shifted to the cathode line $B_2$ in the resetting period and the next $B_2$ scanning period and the devices $E_{2,2}$ and $E_{3,2}$ are lit on. In the case, the emission of the charges of 2e and the charging of the charges of (m−2)(n−1)e are performed in the grounding operation within the $B_1$ scanning period. The emission of the charges of (m−2)(n−1)e occurs in the resetting period. The charging of the charges of [2+(m−2)(n−1)]e is similarly performed in the $B_2$ scanning period. Now, assuming that m=4, a charging amount of the charges in the grounding operation in the $B_1$ scanning period is equal to 2(n−1)e, an emission amount of the charges in the resetting period is equal to 2(n−1)e and a charging amount of the charges in the $B_2$ scanning period is equal to 2ne.

There is a problem such that in the case of getting the intermediate luminance in which the grounding operation is included in the scanning period like the case of the dimmer of 50%, an invalid electric power consumption is larger than that in the case of the maximum luminance of the dimmer of 100%.

OBJECTS AND SUMMARY OF THE INVENTION

It is, therefore, an object of the invention to provide a display apparatus of capacitive light emitting devices which can reduce an electric power consumption in the case of a gradation display and an intermediate luminance and to provide its driving method.

According to the invention, there is provided a driving method of a display apparatus having a plurality of driving lines and a plurality of scanning lines and a plurality of capacitive light emitting devices connected between the scanning lines and the driving lines at a plurality of crossing positions by the driving lines and the scanning lines, comprising the steps of: selecting some of the plurality of driving lines for a scanning period in a predetermined cyclic period consisting of the scanning period and a resetting period subsequent thereto, sequentially selecting one of the plurality of scanning lines, connecting current sources to the selected driving lines, and supplying a current in the forward direction to each of the capacitive light emitting devices between the selected driving lines and the selected one scanning line; and in the resetting period, applying a same electric potential to driving lines to be selected for at least a next scanning period and all of the plurality of scanning lines, thereby discharging charges of the capacitive light emitting devices between the driving lines to be selected and all of the scanning lines, wherein a length of the scanning period in the predetermined cyclic period is changed in response to a luminance information command indicative of a display luminance, and the period other than the scanning period in the predetermined cyclic period is set to the resetting period.

According to the invention, there is provided a display apparatus comprising: a plurality of driving lines and a plurality of scanning lines; a plurality of capacitive light emitting devices connected between the scanning lines and the driving lines at a plurality of crossing positions by the driving lines and the scanning lines; scanning period control means for selecting some of the plurality of driving lines in a scanning period in a predetermined cyclic period consisting of the scanning period and a resetting period subsequent thereto, sequentially selecting one of the plurality of scanning lines, connecting current sources to the selected driving lines, and supplying a current in the forward direction to each of the capacitive light emitting devices between the driving lines to be selected and the selected one scanning line; and resetting period control means for applying a same electric potential to driving lines to be selected for at least a next scanning period and all of the plurality of scanning lines in the resetting period, thereby discharging charges of the capacitive light emitting devices between the driving lines to be selected and all of the scanning lines, wherein a length of the scanning period in the predetermined cyclic period is changed in response to a luminance information command indicative of a display luminance, and the period other than the scanning period in the predetermined cyclic period is set to the resetting period.

DETAILED DESCRIPTION OF THE PREFERRED EMBODIMENTS

An embodiment of the invention will now be described in detail hereinbelow with reference to the drawings.

Figure 10:
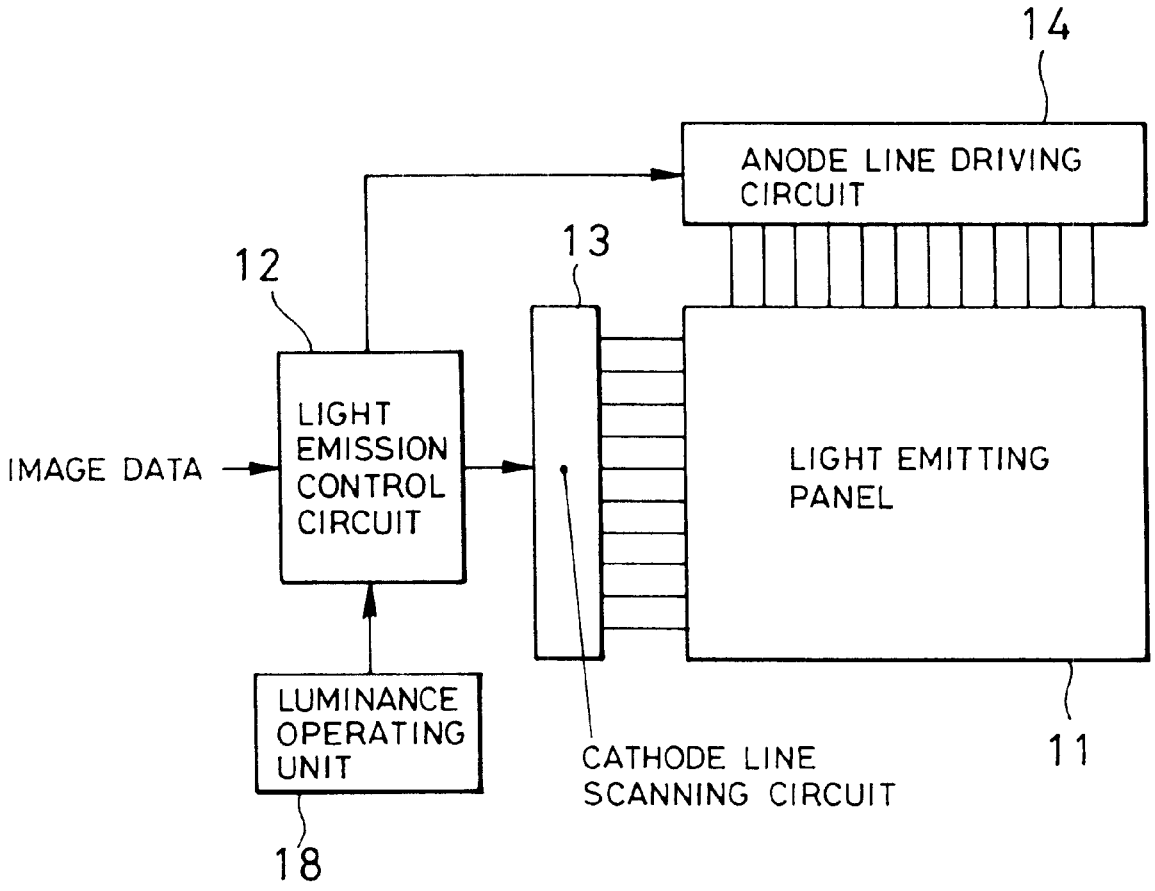
FIG. 10 is a block diagram showing a schematic construction of a display apparatus according to the invention.

FIG. 10 shows a schematic construction of a display apparatus according to an embodiment of the invention using organic electroluminescence devices as capacitive light emitting devices. The display apparatus has a capacitive light emitting panel 11 and a light emission control circuit 12.

In the light emitting panel 11, in a manner similar to that shown in FIGS. 4 to 6 and 8, a plurality of organic electroluminescence devices $E_{i,j}$ ($1 \leqq i \leqq m$, $1 \leqq j \leqq n$) are arranged in a matrix shape at a plurality of crossing positions of the anode lines $A_1$ to $A_m$ of the driving lines and the cathode lines $B_1$ to $B_n$ of the scanning lines and connected between the scanning lines and the driving lines. That is, the organic electroluminescence devices are arranged at crossing positions of a plurality of driving lines which are extended almost in parallel and a plurality of scanning lines which are extended in parallel and each of which is extended almost perpendicularly to each of the driving lines and are connected to the scanning lines and the driving lines, respectively.

A cathode line scanning circuit 13 serving as scan switch means and an anode line driving circuit 14 serving as drive switch means are connected to the light emitting panel 11. The cathode line scanning circuit 13 enables scanning lines to be freely connected to either one of different electric potentials, for example, a ground potential and an inverse bias potential. The anode line driving circuit 14 enables the driving lines to be freely connected to at least one of the ground potential and the inverse bias potential or to a driving source. Although the cathode line scanning circuit 13 is constructed in a manner similar to that shown in FIGS. 4 to 6 and 8, the anode line driving circuit 14 also includes the function of the anode line resetting circuit 3 shown in FIGS. 4 to 6 and 8.

Figure 12:
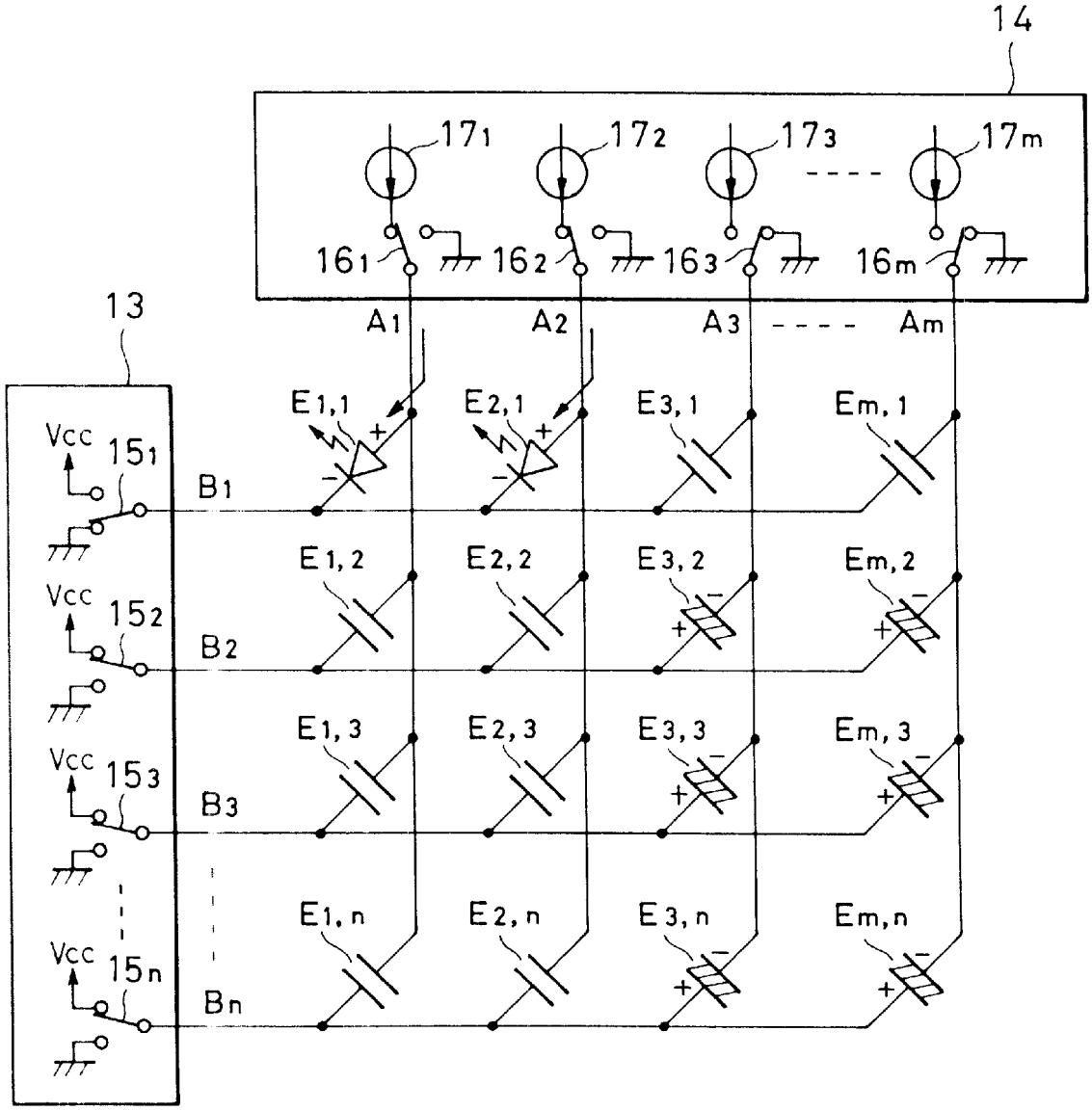
FIG. 12 is a block diagram for explaining a reset driving method which is applied to the display apparatus of FIG. 10.
Figure 13:
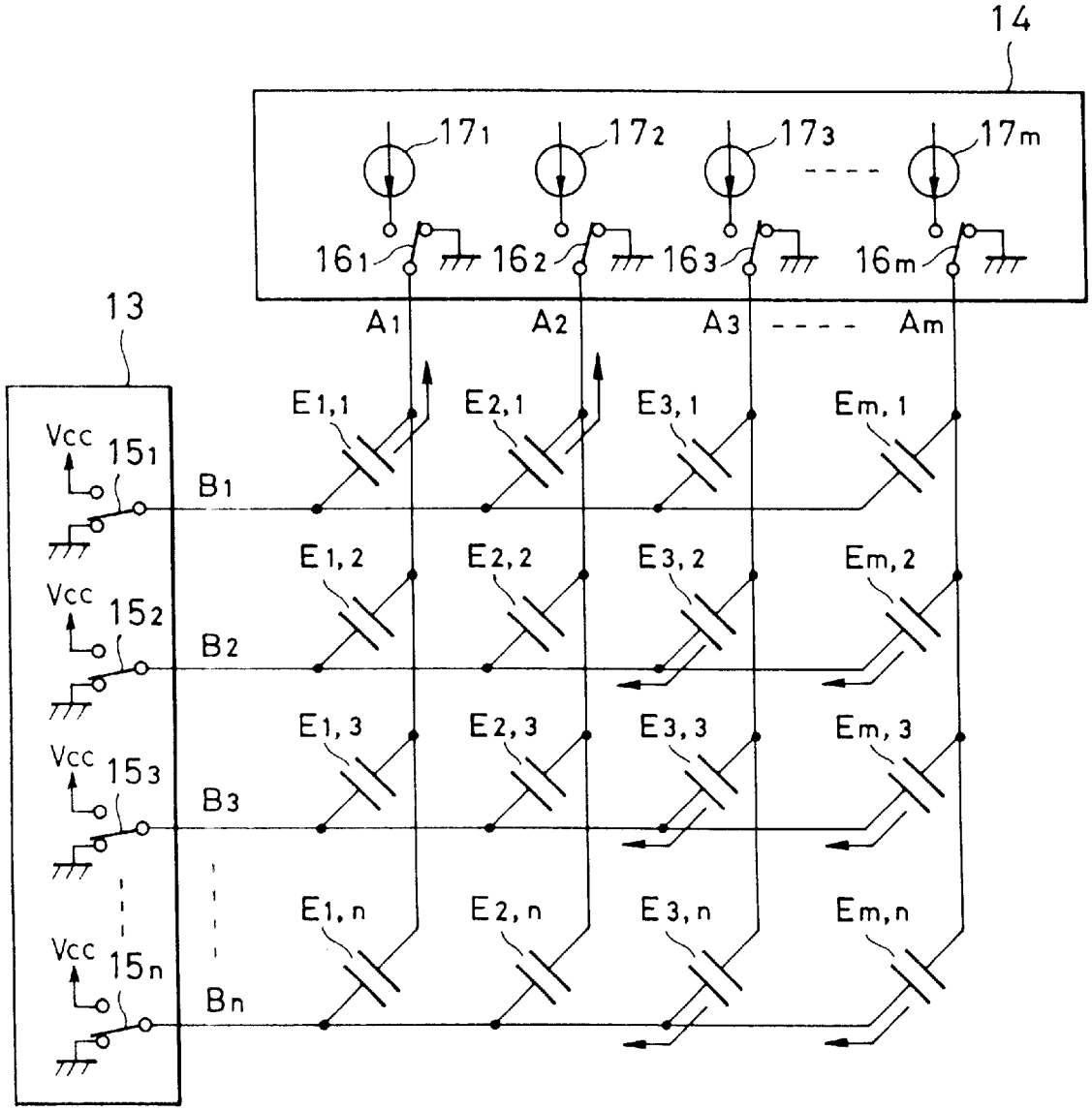
FIG. 13 is a block diagram for explaining a reset driving method which is applied to the display apparatus of FIG. 10.
Figure 14:
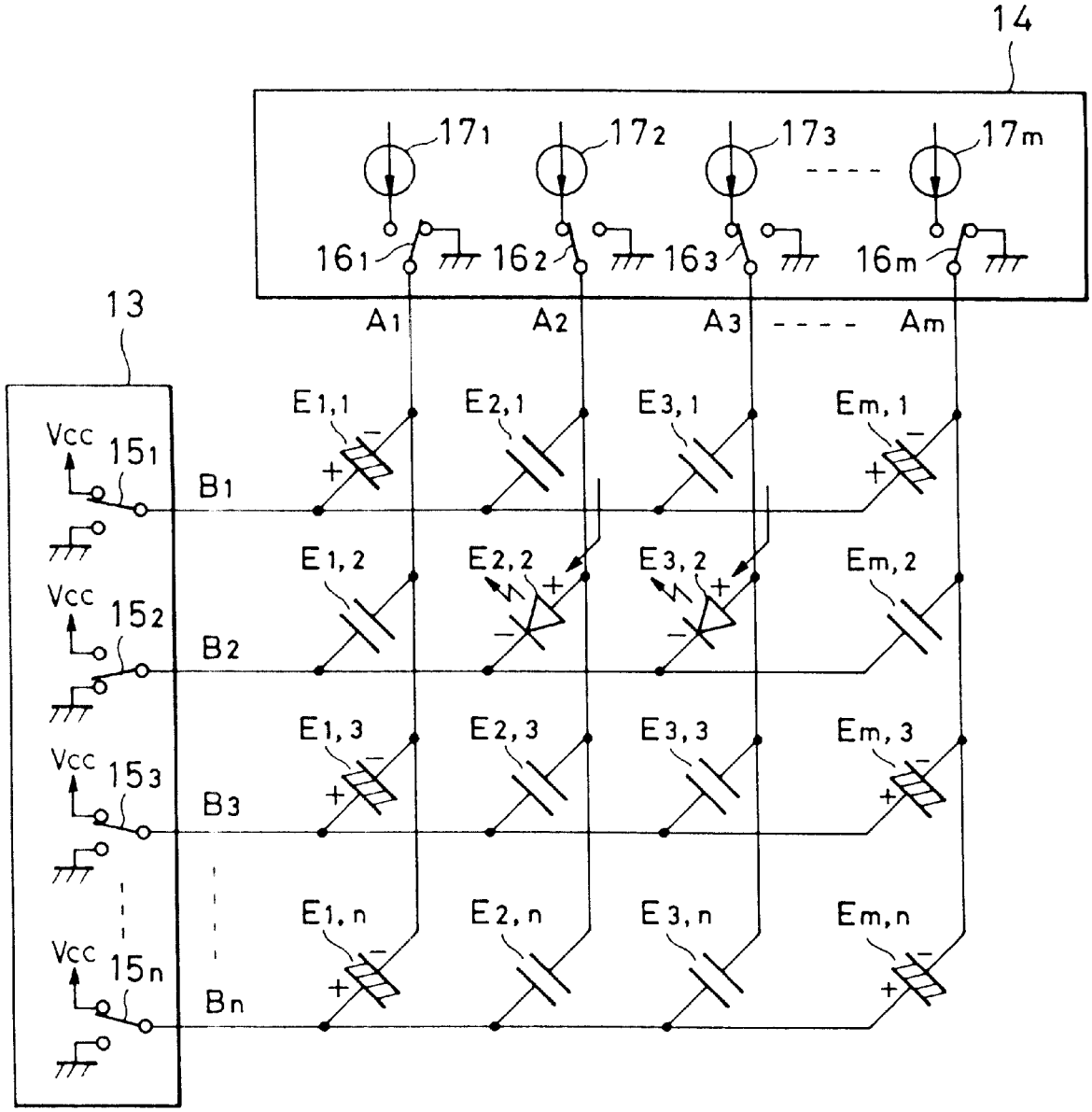
FIG. 14 is a block diagram for explaining a reset driving method which is applied to the display apparatus of FIG. 10.

As shown in FIGS. 12 to 14, the cathode line scanning circuit 13 has scan switches $\mathbf{15}_1$ to $\mathbf{15}_n$ corresponding to the cathode lines $B_1$ to $B_n$ and each scan switch applies one of the inverse bias potential $V_{cc}$ consisting of a power voltage and the ground potential to the corresponding cathode line. The anode line driving circuit 14 has drive switches $\mathbf{16}_1$ to $\mathbf{16}_m$ for switching to either current sources $\mathbf{17}_1$ to $\mathbf{17}_m$ corresponding to the anode lines $A_1$ to $A_m$ or the ground potential and performs a switching control so that each of the drive switches $\mathbf{16}_1$ to $\mathbf{16}_m$ supplies a current to the anode line.

The cathode line scanning circuit 13 and anode line driving circuit 14 are connected to the light emission control circuit 12.

In accordance with image data supplied from an image data generating system (not shown), the light emission control circuit 12 controls the cathode line scanning circuit 13 and anode line driving circuit 14 so as to display an image indicating the image data. The light emission control circuit 12 generates a scanning line selection control signal to the cathode line scanning circuit 13 and performs a control for switching the scan switches $\mathbf{15}_1$ to $\mathbf{15}_n$ in a manner such that one of the cathode lines $B_1$ to $B_n$ corresponding to the horizontal scanning period of the image data is selected and set to the ground potential and the inverse bias potential $V_{cc}$ is applied to the other cathode lines. The inverse bias potential $V_{cc}$ is applied by the constant voltage source connected to the cathode line in order to prevent that the device connected to the crossing point of the anode line which is at present being driven and the cathode line in which a scan selection is not performed emits light due to crosstalk. Since the scan switches $\mathbf{15}_1$ to $\mathbf{15}_n$ have sequentially switched to the ground potential every horizontal scanning period, the cathode lines $B_1$ to $B_n$ set to the ground potential function as scanning lines for enabling the devices connected to the cathode lines to perform the light emission.

The light emission control circuit 12 generates a drive control signal (driving pulse) showing which ones of the devices connected to the scanning lines are made to perform the light emission at which timing and how long in accordance with the pixel information shown by the image data and supplies it to the anode line driving circuit 14. In response to the drive control signal, the anode line driving circuit 14 switches the drive switches corresponding to the light emission among the drive switches $\mathbf{16}_1$ to $\mathbf{16}_m$ to the current source side, supplies a driving current to the relevant devices according to the pixel information through the corresponding ones of the anode lines $A_1$ to $A_m$, and supplies the ground potential to the other anode lines through the drive switches.

A luminance operating unit 18 is connected to the light emission control circuit 12. The luminance operating unit 18 can be operated to adjust a display luminance of the light emitting panel 11 and generates luminance information (percentage of the dimmer) according to the operating position of the user to the light emission control circuit 12.

Figure 11:
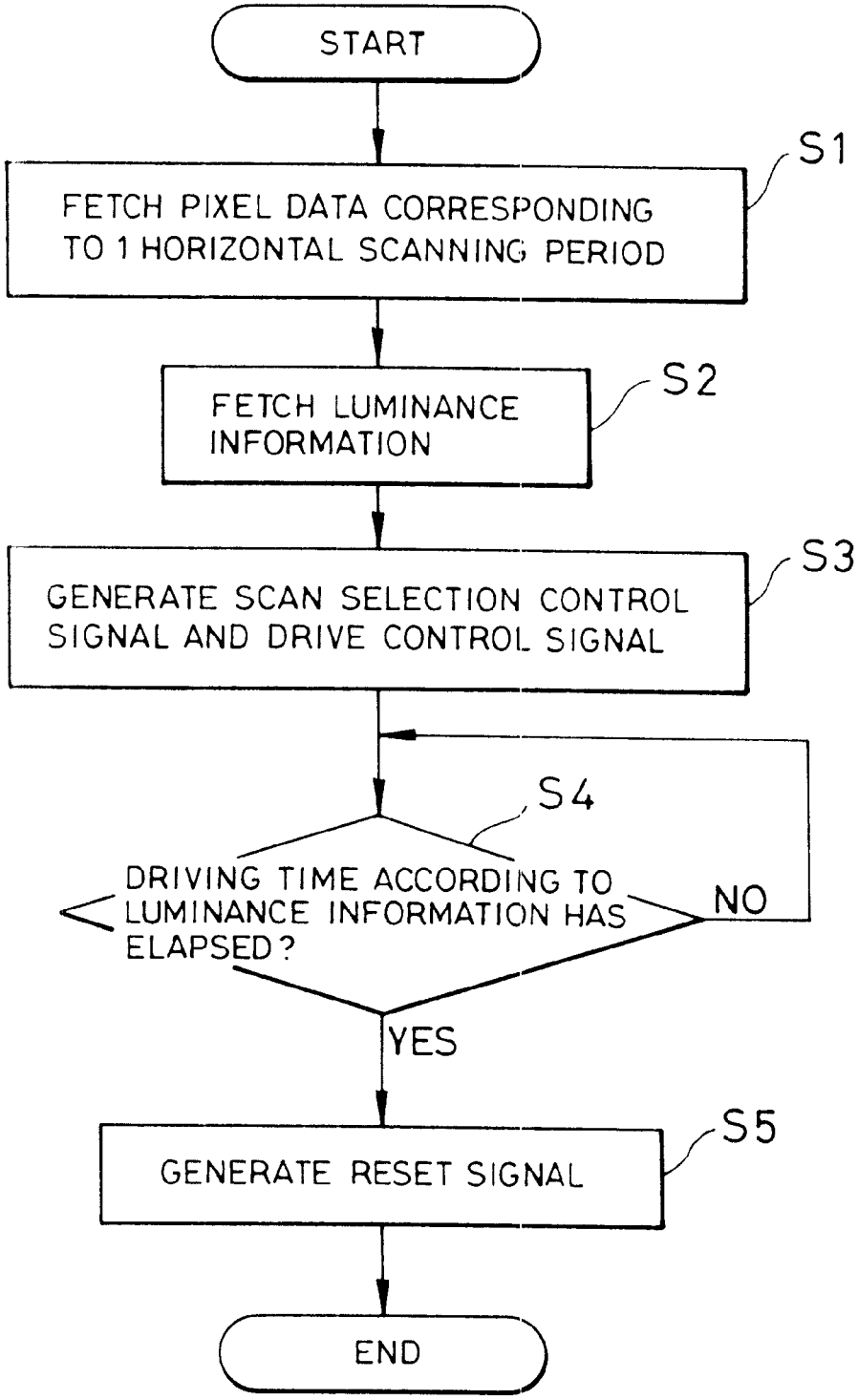
FIG. 11 is a flowchart showing a light emission control routine which is executed by a light emission control circuit.

A driving method of the capacitive light emitting panel in the light emission control circuit 12 will now be described with reference to a flowchart of FIG. 11.

The light emission control circuit 12 executes a light emission control routine every horizontal scanning period of the pixel data that is supplied. In the light emission control routine, first, the pixel data of one horizontal scanning period is fetched (step S1). Luminance information is fetched from the luminance operating unit 18 (step S2). The scan selection control signal and drive control signal are generated in accordance with the pixel information shown by the fetched pixel data of one horizontal scanning period (step S3).

The scan selection control signal is supplied to the cathode line scanning circuit 13. In order to set one of the cathode lines $B_1$ to $B_n$ corresponding to the present horizontal scanning period shown by the scan selection control signal to the ground potential, the cathode line scanning circuit 13 switches the scan switch (one scan switch $\mathbf{15}_S$ among the scan switches $\mathbf{15}_1$ to $\mathbf{15}_n$: S denotes one of 1 to n) corresponding to the relevant one cathode line to the grounding side. The scan switches (all of the scan switches other than the one scan switch $\mathbf{15}_S$ among the scan switches $\mathbf{15}_1$ to $\mathbf{15}_n$) are switched to the grounding side in order to apply the inverse bias potential $V_{cc}$ to the other cathode lines.

The drive control signal is supplied to the anode line driving circuit 14. The anode line driving circuit 14 switches the drive switches (any ones of the drive switches $\mathbf{16}_1$ to $\mathbf{16}_m$) corresponding to the anode lines including the devices to be driven so as to perform the light emission among the anode lines $A_1$ to $A_m$ within the present horizontal scanning period shown by the drive control signal to the current source (corresponding ones of $\mathbf{17}_1$ to $\mathbf{17}_m$) side. The other anode lines are switched to the grounding side. For example, consequently, when the drive switch $\mathbf{16}_1$ is switched to the current source $\mathbf{17}_1$ side, the driving current flows from the current source $\mathbf{17}_1$ to the drive switch $\mathbf{16}_1$, anode line $A_1$, device $E_{1,S}$, cathode line $B_S$, scan switch $\mathbf{15}_S$, and the ground. The device $E_{1,S}$ to which the driving current has been supplied performs the light emission according to the pixel information.

The light emission control circuit 12 discriminates whether the driving time corresponding to the fetched luminance information has elapsed after the execution of step S3 or not (step S4). For a predetermined horizontal scanning period T, a length corresponding to the percentage of the dimmer shown by the fetched luminance information becomes the driving time. For example, when the fetched luminance information indicates the dimmer of 100%, the length of the scanning period T becomes the driving time as it is. When it indicates the dimmer of 50%, the length of the half (namely, T/2) of the scanning period T becomes the driving time. Within the driving time, the light emission of the device driven by the generation of the scan selection control signal and drive control signal in step S3 is continued. The measurement of the driving time is executed by an internal counter (not shown).

When the driving time elapses, the light emission control circuit 12 generates a reset signal (step S5). The reset signal is supplied to the cathode line scanning circuit 13 and anode line driving circuit 14. The cathode line scanning circuit 13 switches movable contacts of all of the scan switches $\mathbf{15}_1$ to $\mathbf{15}_n$ to the grounding side fixed contacts in response to the reset signal. The anode line driving circuit 14 switches movable contacts of all of the drive switches $\mathbf{16}_1$ to $\mathbf{16}_n$ to the grounding side fixed contacts in response to the reset signal. The voltages across all of the devices $E_{i,j}$ are set to the ground potential, thereby discharging charges stored in the devices.

After completion of the execution of step S5, the light emission control circuit 12 finishes the light emission control routine and waits until the next horizontal scanning period is started. The resetting operation in step S5 is continued for a period of time until the next horizontal scanning period is started. When the next horizontal scanning period is started, the operations in steps S1 to S5 are repeated.

The case where the cathode line $B_1$ is scanned by the control operation of the light emission control circuit 12 and the devices $E_{1,1}$ and $E_{2,1}$ are lit on and, after that, the scan is shifted to the cathode line $B_2$ and the devices $E_{2,2}$ and $E_{3,2}$ are lit on will now be described with reference to FIGS. 12 to 14. It is assumed that the luminance information obtained from the luminance operating unit 18 at the time shows the dimmer of 50%. In FIGS. 12 to 14, to make it easy to explain in a manner similar to the case of FIGS. 4 to 6, the lit-on device is shown by the diode symbol and the lit-off light emitting device is shown by a capacitor symbol.

First, in FIG. 12, only the scan switch $\mathbf{15}_1$ is switched to the ground potential side of 0V and the cathode line $B_1$ is scanned. The inverse bias potential $V_{cc}$ is applied to the other cathode lines $B_2$ to $B_n$ by the scan switches $\mathbf{15}_2$ to $\mathbf{15}_n$. At the same time, the current sources $\mathbf{17}_1$ and $\mathbf{17}_2$ are connected to the anode lines $A_1$ and $A_2$ by the drive switches $\mathbf{16}_1$ and $\mathbf{16}_2$. The other anode lines $A_3$ to $A_m$ are switched to the ground potential side of 0V by the drive switches $\mathbf{16}_3$ to $\mathbf{16}_m$. In the case of FIG. 12, therefore, only the devices $E_{1,1}$ and $E_{2,1}$ are biased in the forward direction, the driving current flows from the current sources $\mathbf{17}_1$ and $\mathbf{17}_2$ as shown by arrows, and only the devices $E_{1,1}$ and $E_{2,1}$ perform the light emission. In the light emitting state, each of the non-light emitting devices $E_{3,2}$ to $E_{m,n}$ shown by hatched capacitor symbols is charged to a polarity as shown in the diagram. The light emitting state is continued only for the driving time of T/2 of the length of the half of the scanning period T.

When the driving time T/2 elapses from the stationary light emitting state of FIG. 12, the reset control is performed before the scan is shifted to the state where the light emission of the next devices $E_{2,2}$ and $E_{3,2}$ is performed. As shown in FIG. 13, all of the drive switches $\mathbf{16}_1$ to $\mathbf{16}_m$ and all of the scan switches $\mathbf{15}_1$ to $\mathbf{15}_n$ are switched to the ground potential side of 0V and all of the anode lines $A_1$ to $A_m$ and cathode lines $B_1$ to $B_n$ are set to the same ground potential of 0V. By the reset control, since all of the anode lines and cathode lines are set to the same electric potential of 0V, the charges stored in each device are discharged along routes as shown by arrows in the diagram. The stored charges of all of the devices are instantaneously extinguished.

After the stored charges of all devices were set to zero in the manner, when the next horizontal scanning period is started, subsequently, as shown in FIG. 14, only the scan switch $\mathbf{15}_2$ corresponding to the cathode line $B_2$ is switched to the 0V side and the cathode line $B_2$ is scanned. At the same time, the drive switches $\mathbf{16}_2$ and $\mathbf{16}_3$ are switched to the side of the current sources $\mathbf{17}_2$ and $\mathbf{17}_3$ and connected to the corresponding anode lines. Also, the other drive switches $\mathbf{16}_1$ and $\mathbf{16}_4$ to $\mathbf{16}_m$ are held in a state where they were switched to the ground potential side, and 0V is applied to the anode lines $A_1$ and $A_4$ to $A_m$. In the case of FIG. 14, therefore, only the devices $E_{2,2}$ and $E_{3,2}$ are biased in the forward direction, the driving current flows from the current sources $\mathbf{17}_2$ and $\mathbf{17}_3$ as shown by arrows, and only the devices $E_{2,2}$ and $E_{3,2}$ perform the light emission. In the light emitting state, each of the non-light emitting devices $E_{1,1}$, $E_{1,3}$ to $E_{1,n}$, $E_{4,1}$ to $E_{m,1}$, and $E_{4,3}$ to $E_{m,n}$ shown by hatched capacitor symbols is charged to a polarity as shown in the diagram.

Figure 1:
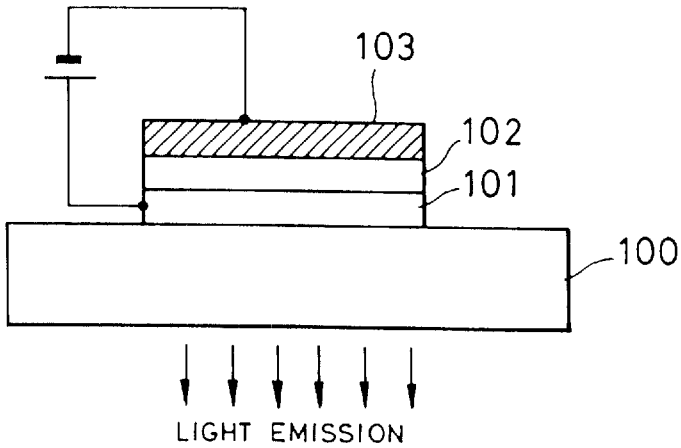
FIG. 1 is a cross sectional view of an organic electroluminescence device.
Figure 2:
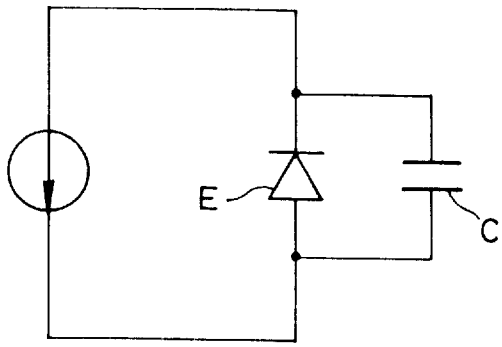
FIG. 2 is a diagram showing an equivalent circuit of the organic electroluminescence device.
Figure 3:
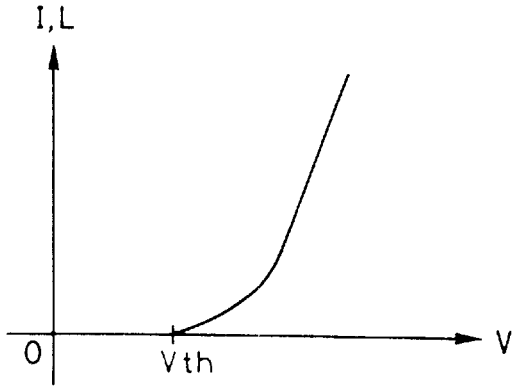
FIG. 3 is a diagram schematically showing characteristics of a driving voltage—a current—a light emission luminance of the organic electroluminescence device.
Figure 4:
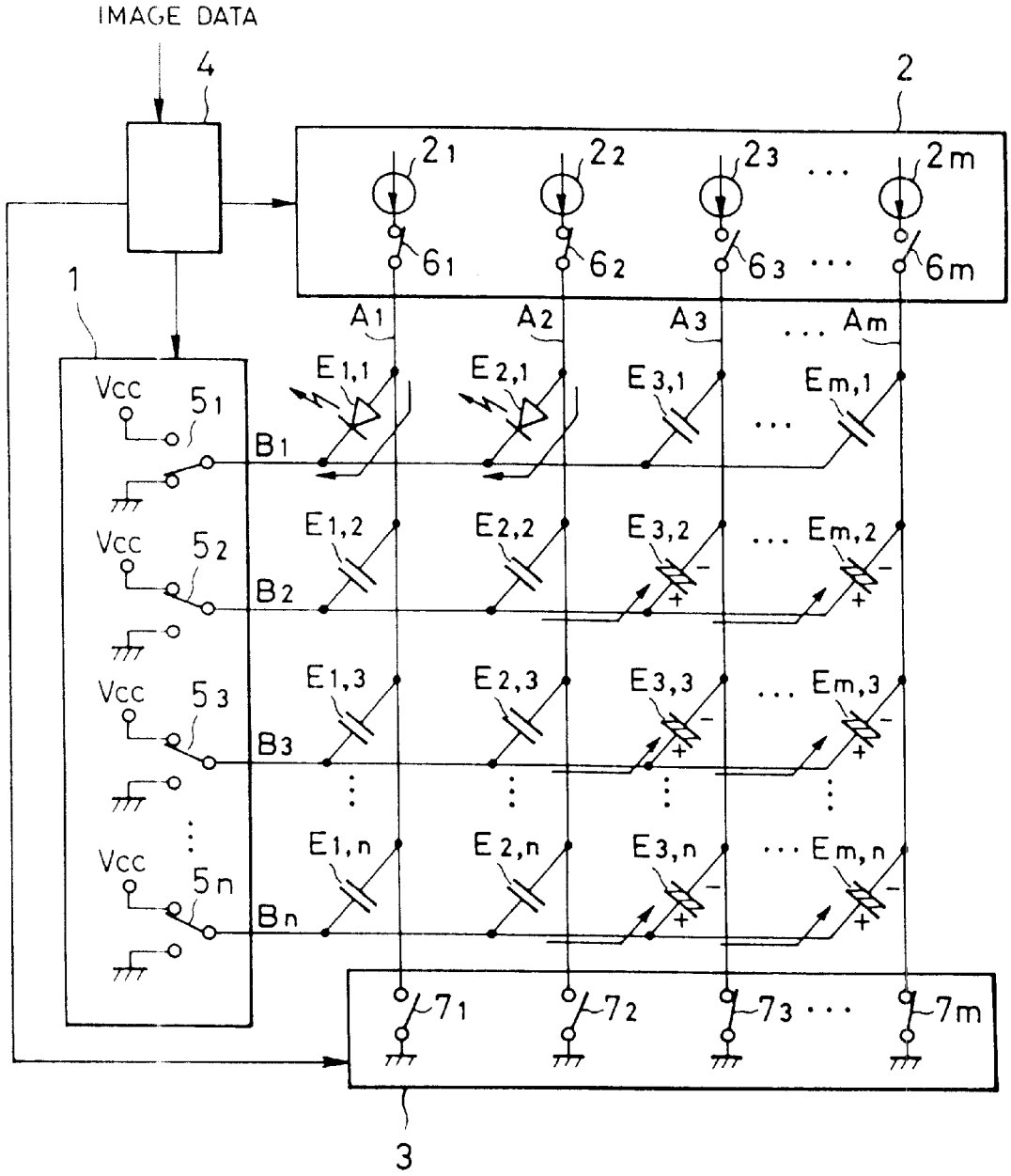
FIG. 4 is a block diagram for explaining a reset driving method which is applied to a display apparatus using conventional organic electroluminescence devices.
Figure 5:
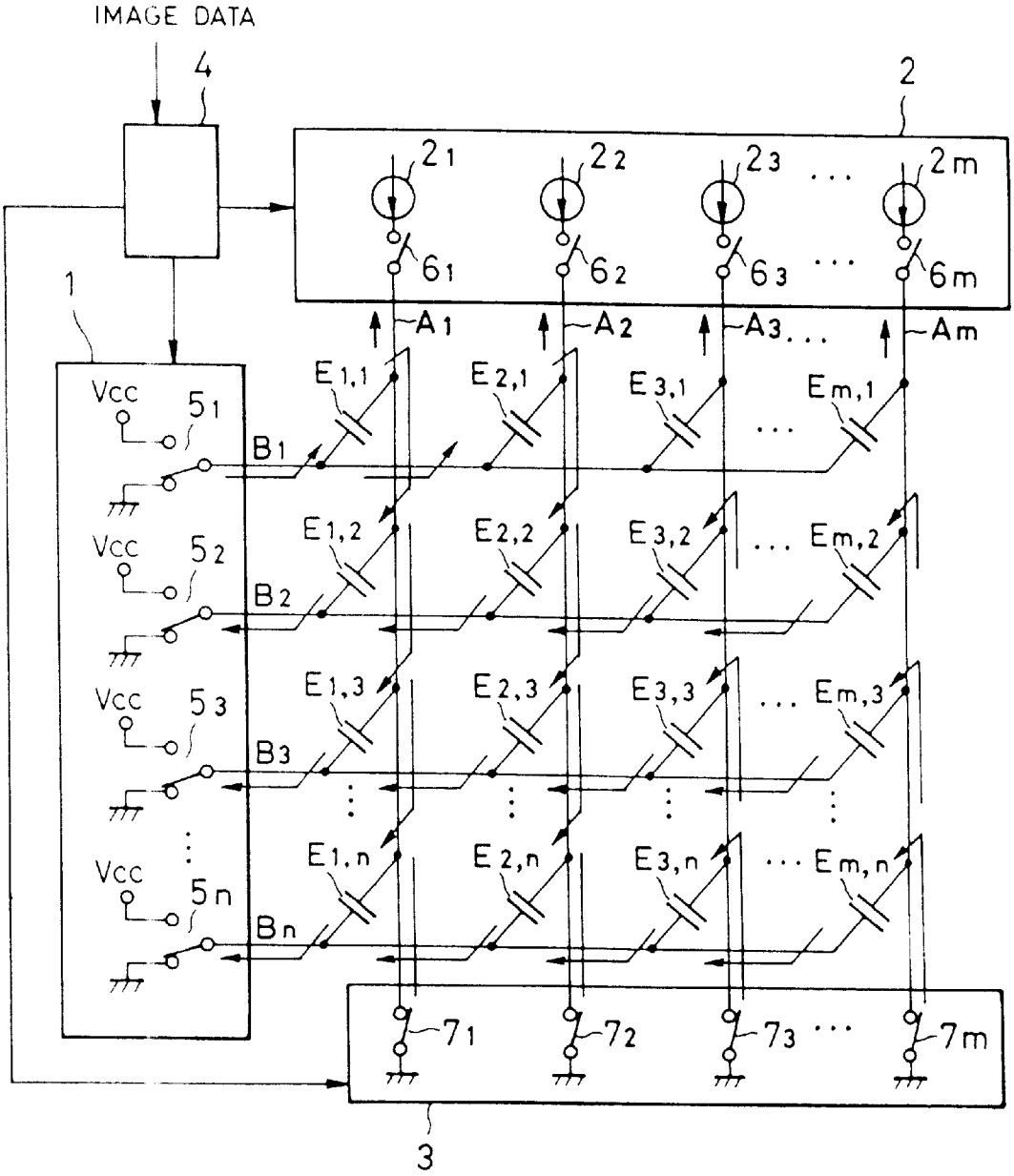
FIG. 5 is a block diagram for explaining a reset driving method which is applied to the display apparatus using the conventional organic electroluminescence devices.
Figure 6:
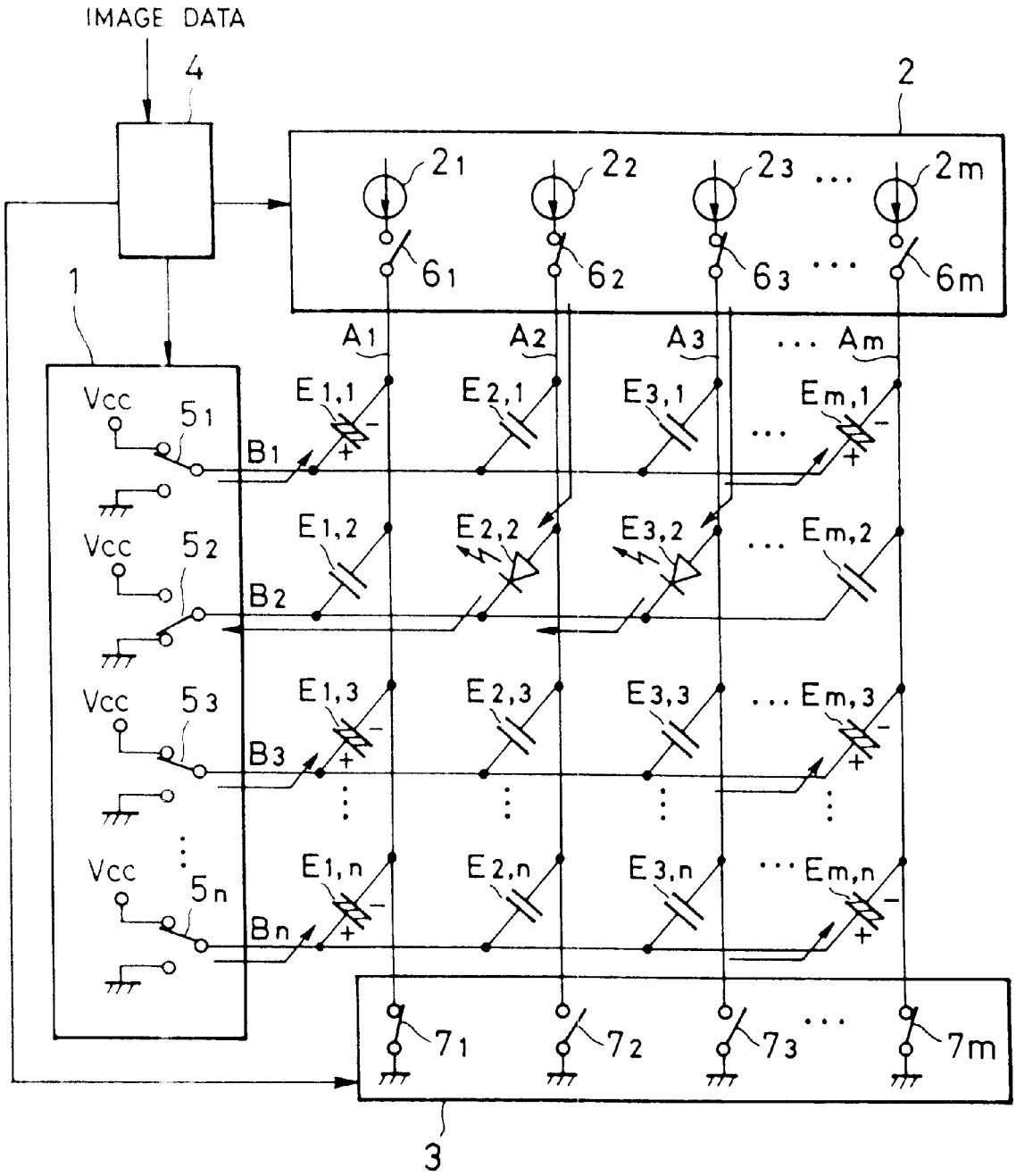
FIG. 6 is a block diagram for explaining a reset driving method which is applied to the display apparatus using the conventional organic electroluminescence devices.
Figure 7:
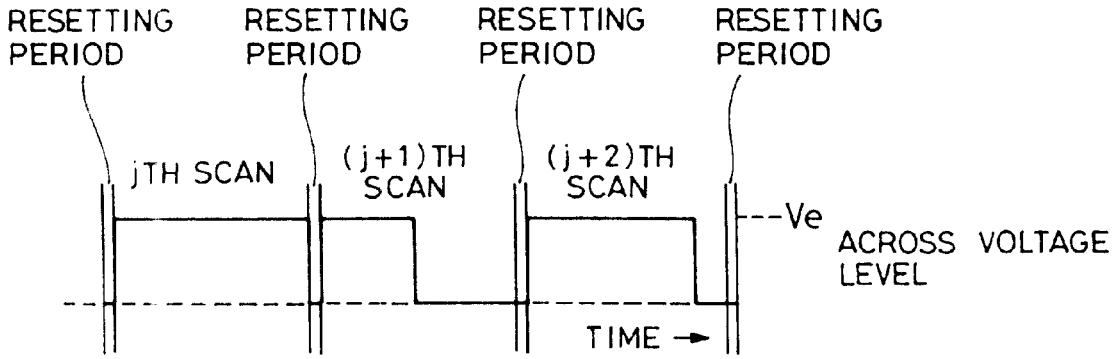
FIG. 7 is a diagram for explaining a luminance adjustment of the display apparatus using the conventional organic electroluminescence devices.
Figure 8:
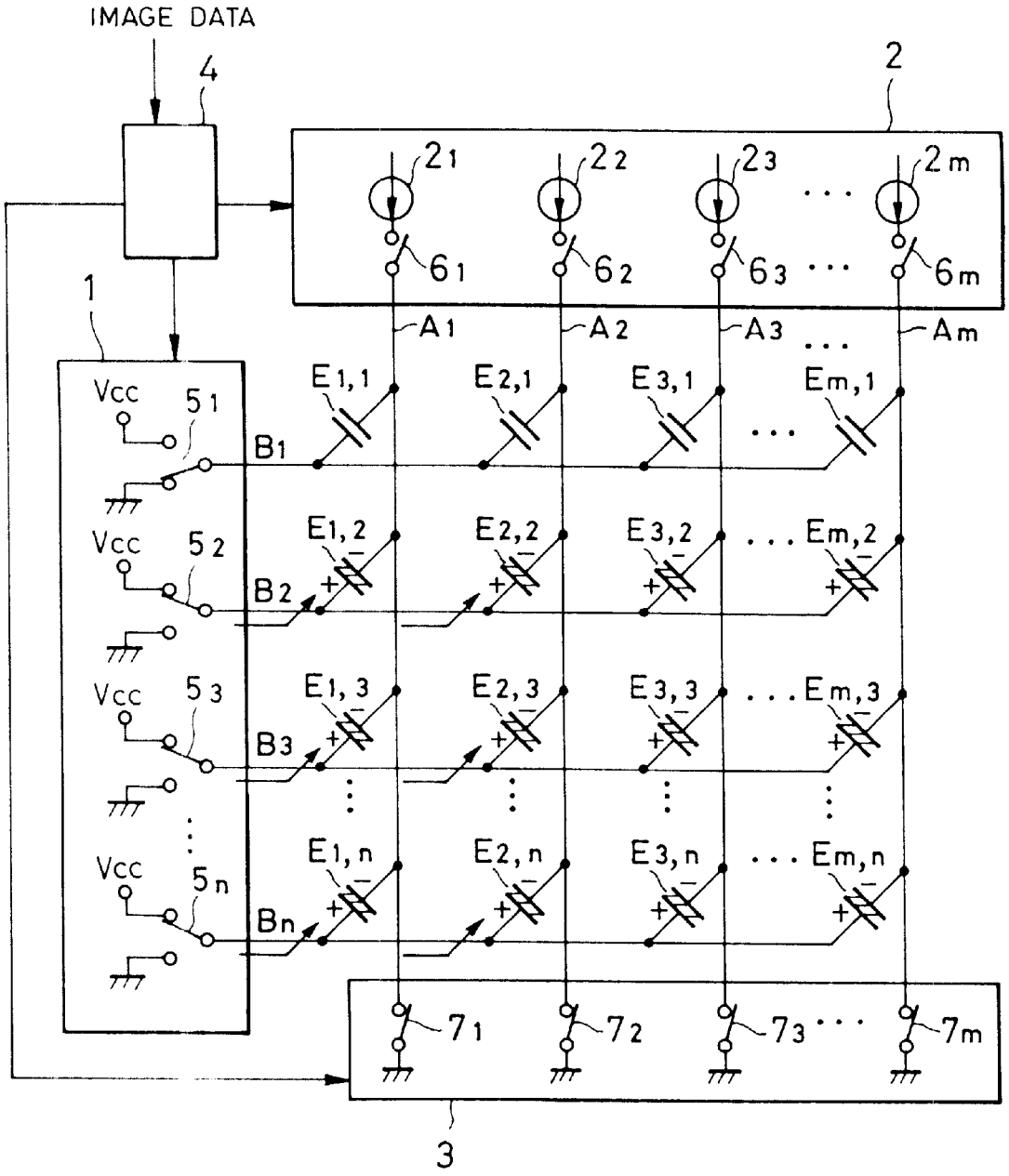
FIG. 8 is a block diagram for explaining a reset driving method in the case where the grounding operation is included in a scanning period.
Figure 9A:
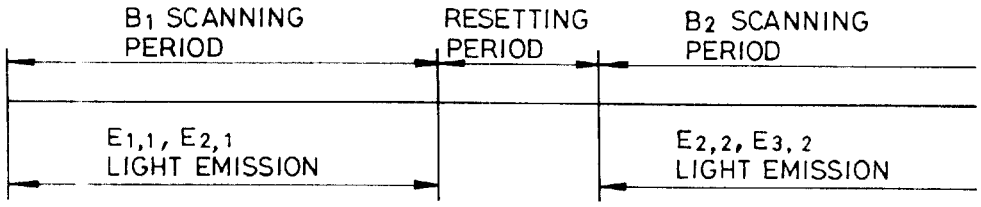
FIGS. 9A and 9B are diagrams showing timing charts of a conventional reset driving method.
Figure 9B:
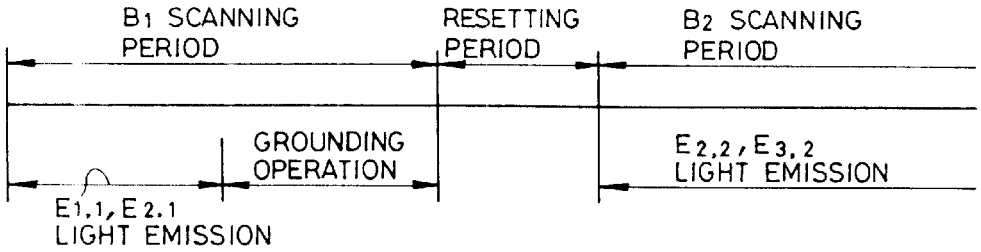
Figure 15:
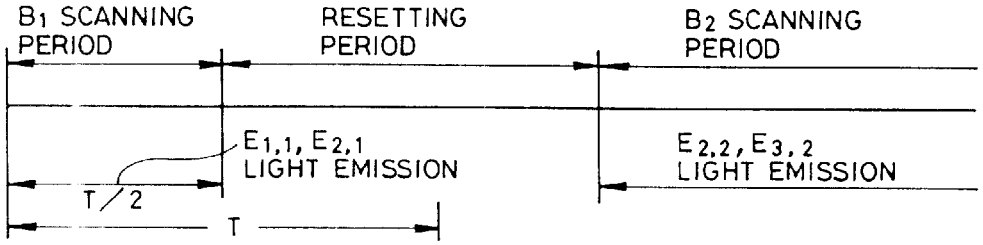
FIG. 15 is a diagram showing a timing chart of the reset driving methods shown in FIGS. 12 to 14.

In the $B_1$ scanning period of the dimmer of 50%, as shown in FIG. 15, the light emitting operation such that the cathode line $B_1$ is scanned to thereby allow the devices $E_{1,1}$ and $E_{2,1}$ to emit the light is executed only for the driving time T/2 and, after that, the resetting period comes. In the resetting period, the voltages across all of the devices are set to the same ground potential as mentioned above. The resetting period is continued until the next $B_2$ scanning period is started. In the $B_2$ scanning period, the scan is shifted to the cathode line $B_2$, thereby allowing the devices $E_{2,2}$ and $E_{3,2}$ to perform the light emission. In the case, when the $B_1$ scanning period is shifted to the resetting period, the emission of the charges of $[2+(m-2)(n-1)]e$ occurs. In the $B_2$ scanning period, the charging of the charges of $[2+(m-2)(n-1)]e$ is similarly performed. Now, assumed that m=4 to make the explanation easy, the emission amount of the charges in the resetting period is equal to 2ne and the charging amount of the charges in the $B_2$ scanning period is equal to 2ne. That is, the charges of 4ne are consumed as a whole by the operations of FIGS. 12 to 14 and an amount of charges to be consumed can be reduced to a value lower than that by the conventional reset driving method.

Figure 16:
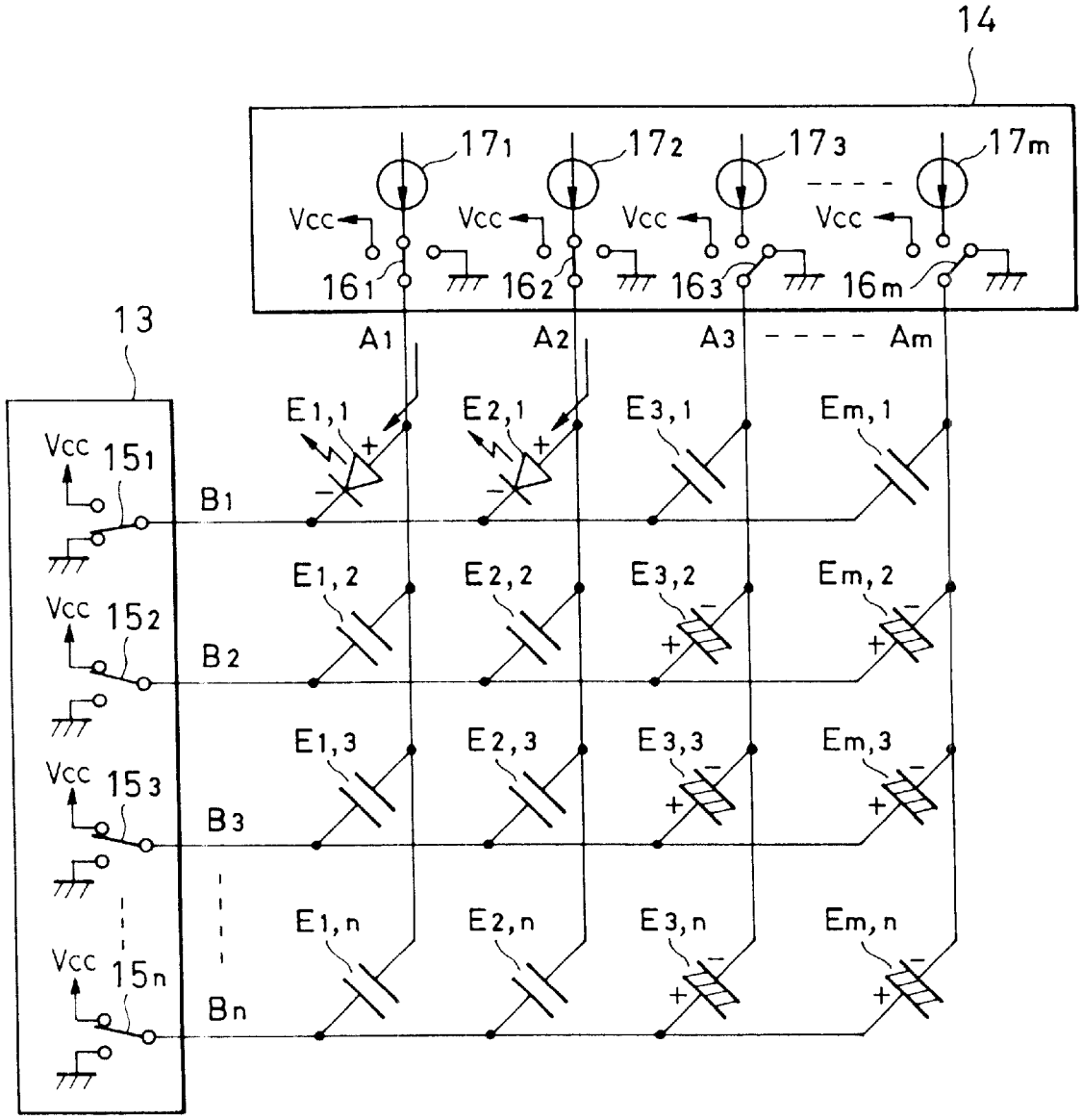
FIG. 16 is a block diagram for explaining a reset driving method which is applied to the display apparatus of FIG. 10.
Figure 17:
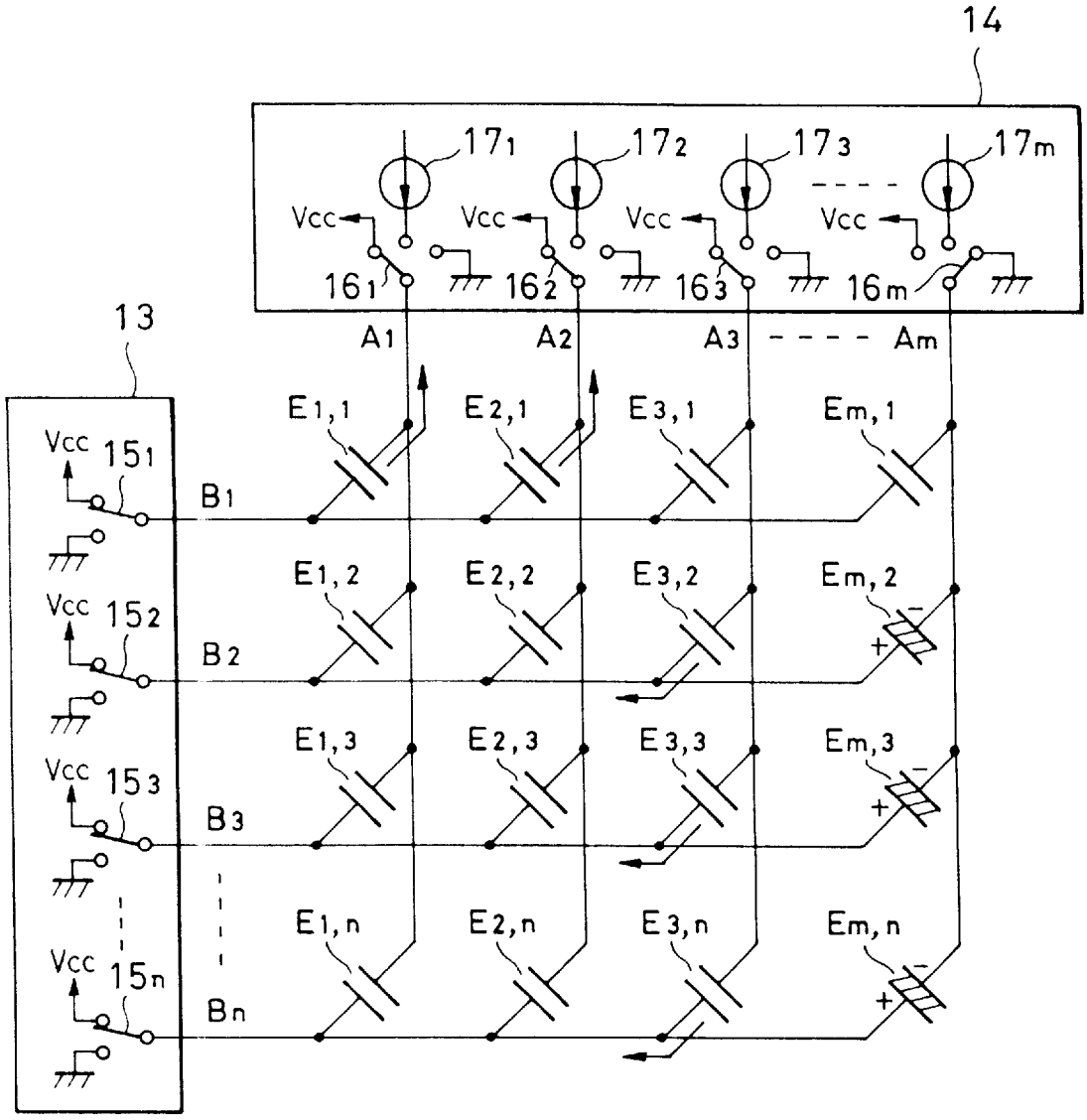
FIG. 17 is a block diagram for explaining a reset driving method which is applied to the display apparatus of FIG. 10.
Figure 18:
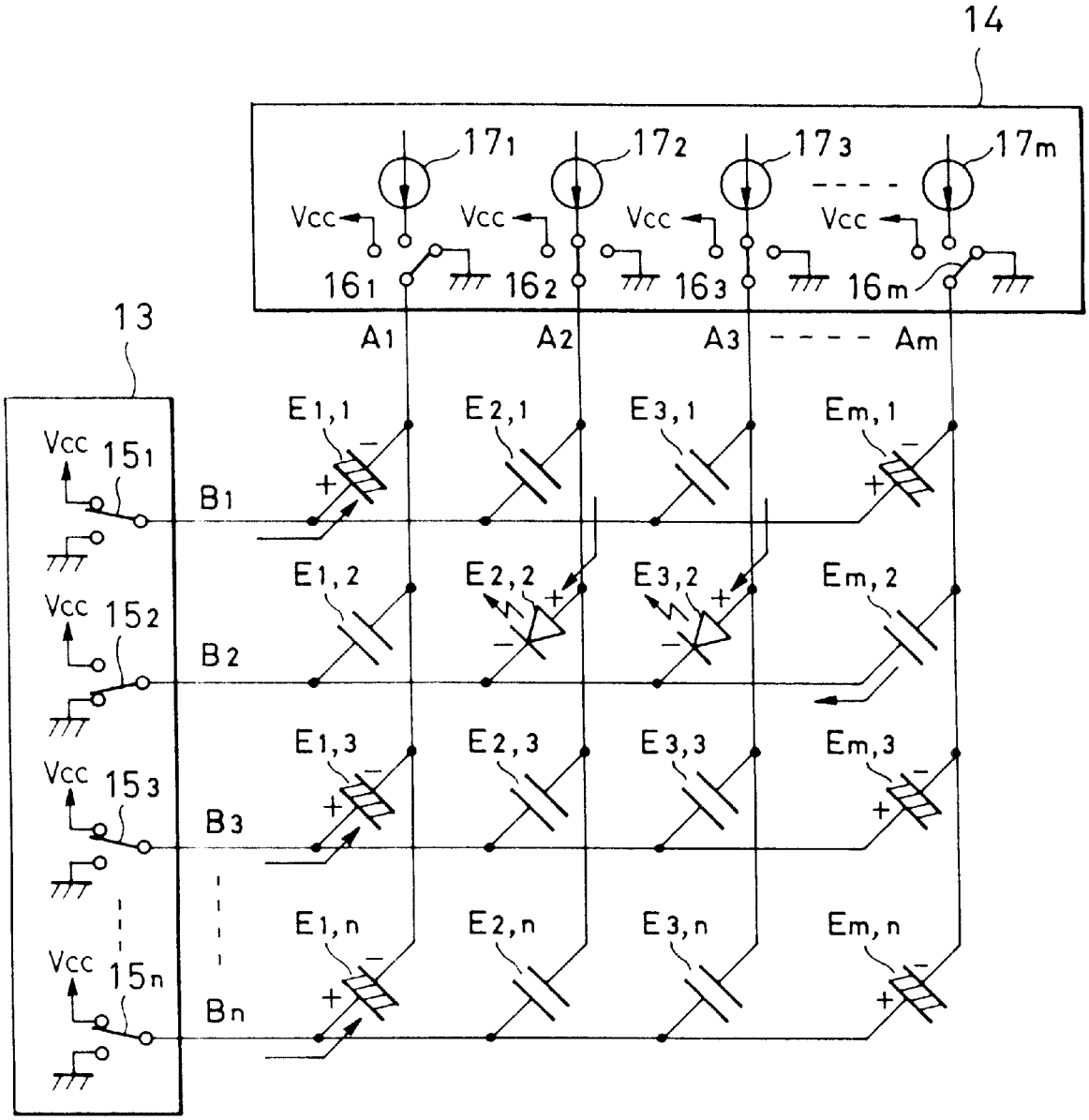
FIG. 18 is a block diagram for explaining a reset driving method which is applied to the display apparatus of FIG. 10.

FIGS. 16 to 18 show another embodiment of the invention. In the embodiment, each of the drive switches $\mathbf{16}_1$ to $\mathbf{16}_m$ in the anode line driving circuit 14 of the display apparatus has three fixed contacts. The bias potential $V_{cc}$ is applied to the first fixed contact. The current source (one of $\mathbf{17}_1$ to $\mathbf{17}_m$) is connected to the second fixed contact. The third fixed contact is connected to the ground. The movable contact of each of the drive switches $\mathbf{16}_1$ to $\mathbf{16}_m$ is connected to one of the first to third fixed contacts in response to the drive control signal or reset signal from the light emission control circuit 12. The other construction is similar to that shown in FIGS. 10 and 12 to 14.

FIGS. 16 to 18 show operating states of the $B_1$ scanning period, resetting period, and $B_2$ scanning period in the case where the cathode line $B_1$ is scanned to thereby allow the devices $E_{1,1}$ and $E_{2,1}$ to perform the light emission by the control operation of the light emission control circuit 12 and, after that, the scan is shifted to the cathode line $B_2$ to thereby allow the devices $E_{2,2}$ and $E_{3,2}$ to perform the light emission, respectively. It is assumed that the luminance information obtained from the luminance operating unit 18 at the time is equal to a dimmer of 50%. The operating states will now be described.

First, in FIG. 16, only the scan switch $\mathbf{15}_1$ is switched to the ground potential side of 0V and the cathode line $B_1$ is scanned. The inverse bias potential $V_{cc}$ is applied to the other cathode lines $B_2$ to $B_n$ by the scan switches $\mathbf{15}_2$ to $\mathbf{15}_n$. At the same time, the current sources $\mathbf{17}_1$ and $\mathbf{17}_2$ are connected to the anode lines $A_1$ and $A_2$ by the drive switches $\mathbf{16}_1$ and $\mathbf{16}_2$. The other anode lines $A_3$ to $A_m$ are switched to the ground potential side of 0V by the drive switches $\mathbf{16}_3$ to $\mathbf{16}_m$. In the case of FIG. 16, therefore, only the devices $E_{1,1}$ and $E_{2,1}$ are biased in the forward direction, the driving current flows from the current sources $\mathbf{17}_1$ and $\mathbf{17}_2$ as shown by arrows, and only the devices $E_{1,1}$ and $E_{2,1}$ perform the light emission. In the light emitting state, each of the non-light emitting devices $E_{3,2}$ to $E_{m,n}$ shown by hatched capacitor symbols is charged to a polarity as shown in the diagram. The light emitting state is continued only for the driving time of T/2 of the length of the half of the scanning period T.

When the driving time T/2 elapses from the stationary light emitting state of FIG. 16, the reset control is performed before the scan is shifted to the state where the light emission of the next devices $E_{2,2}$ and $E_{3,2}$ is performed. As shown in FIG. 17 the drive switches $\mathbf{16}_1$ to $\mathbf{16}_3$ are switched so as to apply the bias potential $V_{cc}$ to the anode lines $A_1$ to $A_3$. The other drive switches $\mathbf{16}_4$ to $\mathbf{16}_m$ relay and supply the ground potential as it is to the anode lines $A_4$ to $A_m$. All of the scan switches $\mathbf{15}_1$ to $\mathbf{15}_n$ are switched to the inverse bias potential $V_{cc}$ side. All of the anode lines $A_1$ to $A_3$ and cathode lines $B_1$ to $B_n$ are set to the same potential $V_{cc}$. By the reset control, since the voltage across each of the devices $E_{1,1}$ to $E_{3,n}$ is set to the same electric potential of $V_{cc}$, the charges stored in each of the devices $E_{1,1}$, $E_{2,1}$, and $E_{3,2}$ to $E_{3,n}$ are discharged along routes as shown by arrows in the diagram. The stored charges of those devices are instantaneously extinguished. The charging state of each of the devices $E_{4,2}$ to $E_{m,n}$ is continued.

After the resetting period as mentioned above, when the next horizontal scanning period is started, only the scan switch $\mathbf{15}_2$ corresponding to the cathode line $B_2$ is now switched to the 0V side as shown in FIG. 18 and the cathode line $B_2$ is scanned. At the same time, the drive switches $\mathbf{16}_2$ and $\mathbf{16}_3$ are switched to the side of the current sources $\mathbf{17}_2$ and $\mathbf{17}_3$ and connected to the corresponding anode lines. The other drive switches $\mathbf{16}_1$ and $\mathbf{16}_4$ to $\mathbf{16}_m$ are switched to the ground potential side and 0V is applied to the anode lines $A_1$ and $A_4$ to $A_m$. In the case of FIG. 18, therefore, only the devices $E_{2,2}$ and $E_{3,2}$ are biased in the forward direction. The driving current flows from the current sources $\mathbf{17}_2$ and $\mathbf{17}_3$ as shown by arrows and only the devices $E_{2,2}$ and $E_{3,2}$ perform the light emission. In the light emitting state, each of the non-light emitting devices $E_{1,1}$, $E_{1,3}$ to $E_{1,n}$, $E_{4,1}$ to $E_{m,1}$, and $E_{4,3}$ to $E_{m,n}$ shown by hatched capacitor symbols is charged to a polarity as shown in the diagram.

A length of the $B_1$ scanning period when the scan is shifted from the $B_1$ scanning period of the dimmer of 50% to the $B_2$ scanning period and a length of the resetting period in the case of using the driving method shown in FIGS. 16 to 18 are similar to those shown in FIG. 15. When shifting from the $B_1$ scanning period to the resetting period, the emission of the charges of (n+1)e occurs. In the $B_2$ scanning period, the discharge of the charges of (m−3)e and the charging of the charges of (m+n−2)e are similarly performed. Now, assuming that m=4, an emission amount of the charges in the $B_2$ scanning period is equal to e and a charging amount is equal to (n+2)e. That is, a whole amount of charges to be consumed is equal to (2n+4)e by the operations of FIGS. 16 to 18 and an amount of charges to be consumed can be reduced as compared with that in the conventional reset driving method.

Figure 19:
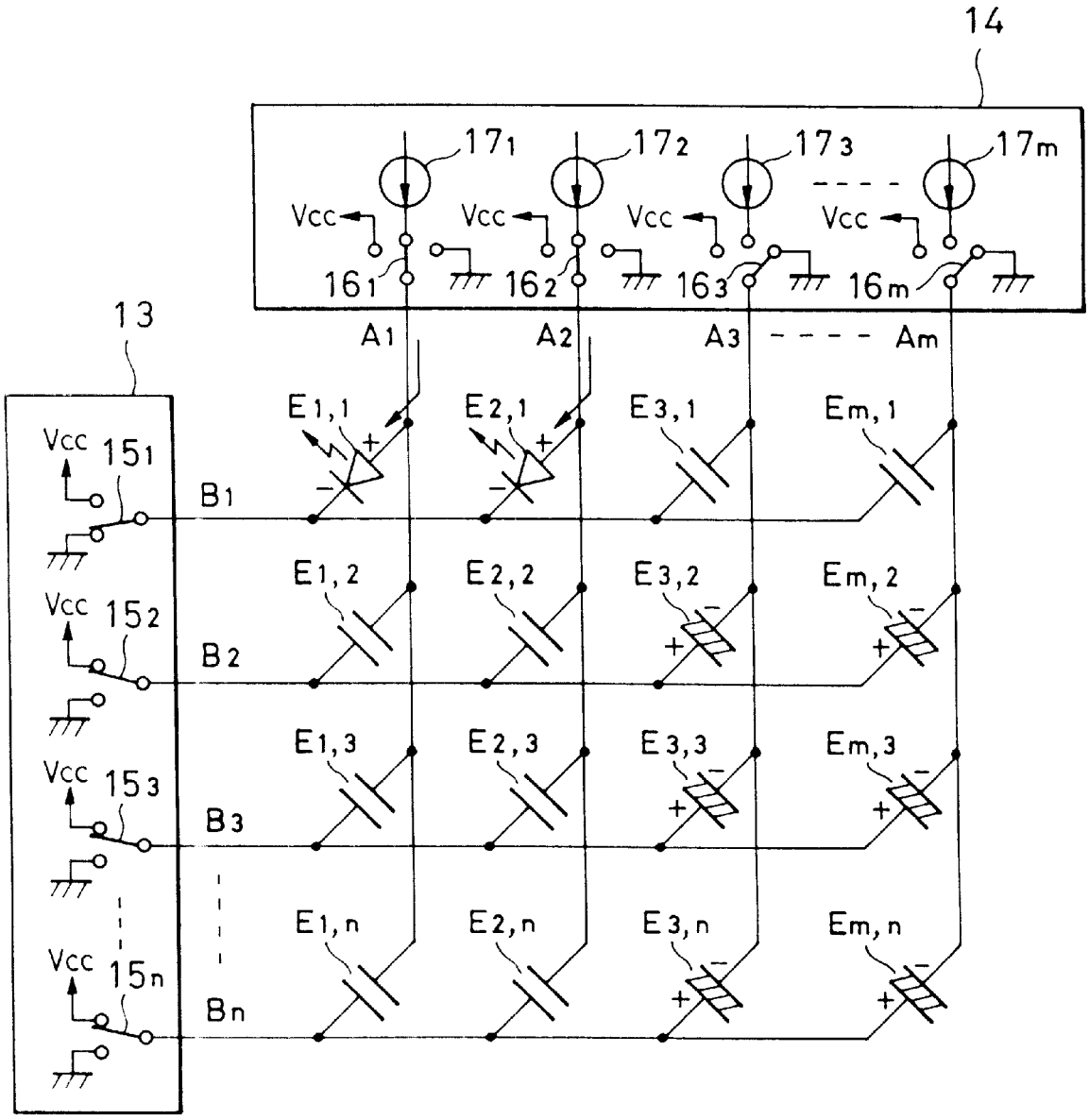
FIG. 19 is a block diagram for explaining a reset driving method which is applied to the display apparatus of FIG. 10.
Figure 20:
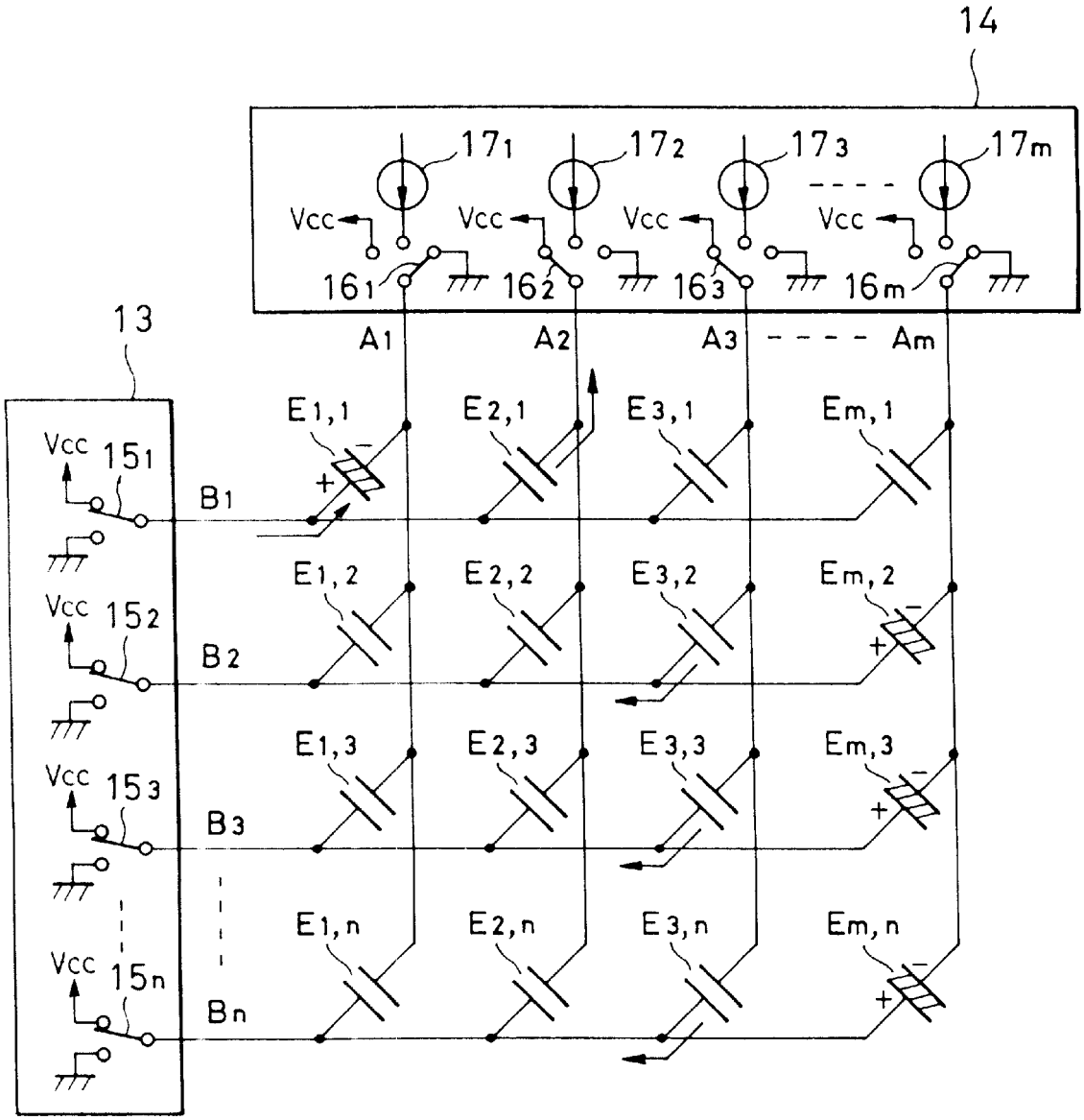
FIG. 20 is a block diagram for explaining a reset driving method which is applied to the display apparatus of FIG. 10.
Figure 21:
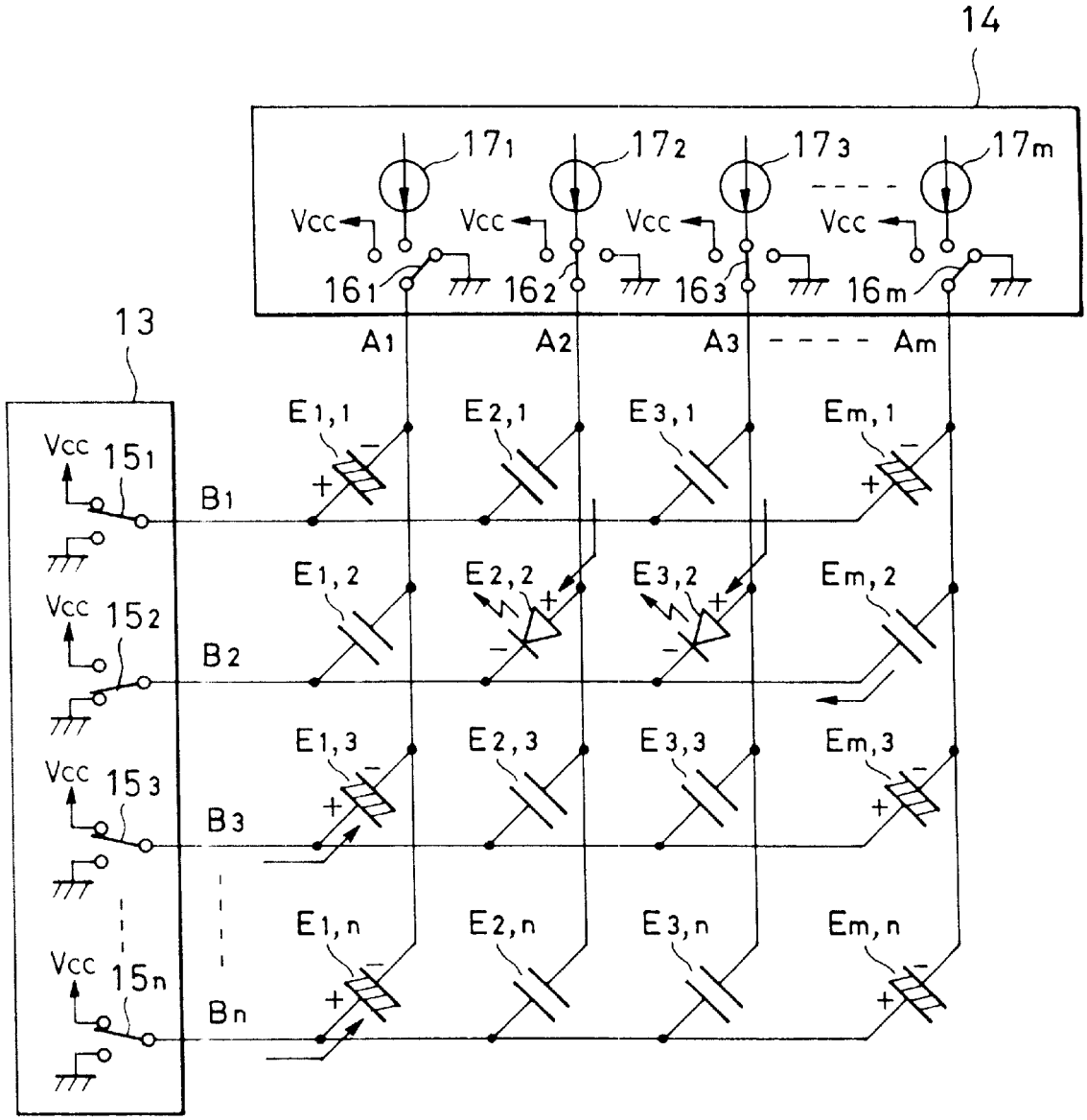
FIG. 21 is a block diagram for explaining a reset driving method which is applied to the display apparatus of FIG. 10.

FIGS. 19 to 21 show further another embodiment of the invention. In the embodiment, a construction of a display apparatus is similar to that in the embodiment shown in FIGS. 10 and 16 to 18.

FIGS. 19 to 21 show operating states of the $B_1$ scanning period, resetting period, and $B_2$ scanning period in the case where the cathode line $B_1$ is scanned to thereby allow the devices $E_{1,1}$ and $E_{2,1}$ to perform the light emission by the control operation of the light emission control circuit 12 and, thereafter, the scan is shifted to the cathode line $B_2$ to thereby allow the devices $E_{2,2}$ and $E_{3,2}$ to perform the light emission, respectively. It is assumed that the luminance information obtained from the luminance operating unit 18 at the time shows the dimmer of 50%. The operating states will now be described.

First, in FIG. 19, only the scan switch $\mathbf{15}_1$ is switched to the ground potential side of 0V and the cathode line $B_1$ is scanned. The inverse bias potential $V_{cc}$ is applied to the other cathode lines $B_2$ to $B_n$ by the scan switches $\mathbf{15}_2$ to $\mathbf{15}_n$. At the same time, the current sources $\mathbf{17}_1$ and $\mathbf{17}_2$ are connected to the anode lines $A_1$ and $A_2$ by the drive switches $\mathbf{16}_1$ and $\mathbf{16}_2$. The other anode lines $A_3$ to $A_m$ are switched to the ground potential side of 0V by the drive switches $\mathbf{16}_3$ to $\mathbf{16}_m$. In the case of FIG. 16, therefore, only the devices $E_{1,1}$ and $E_{2,1}$ are biased in the forward direction, the driving current flows from the current sources $\mathbf{17}_1$ and $\mathbf{17}_2$ as shown by arrows, and only the devices $E_{1,1}$ and $E_{2,1}$ perform the light emission. In the light emitting state, each of the non-light emitting devices $E_{3,2}$ to $E_{m,n}$ shown by hatched capacitor symbols is charged to a polarity as shown in the diagram. The light emitting state is continued only for the driving time of T/2 of the length of the half of the scanning period T.

When the driving time T/2 elapses from the stationary light emitting state of FIG. 19, the reset control is performed before the scan is shifted to the state where the light emission of the next devices $E_{2,2}$ and $E_{3,2}$ is performed. As shown in FIG. 20, the drive switches $\mathbf{16}_2$ and $\mathbf{16}_3$ are switched so as to apply the bias potential $V_{cc}$ to the anode lines $A_2$ and $A_3$. The other drive switches $\mathbf{16}_1$ and $\mathbf{16}_4$ to $\mathbf{16}_m$ relay and supply the ground potential to the anode lines $A_1$ and $A_4$ to $A_m$. All of the scan switches $\mathbf{15}_1$ to $\mathbf{15}_n$ are switched to the inverse bias potential $V_{cc}$ side. All of the anode lines $A_2$ and $A_3$ and cathode lines $B_1$ to $B_n$ are set to the same potential $V_{cc}$. By the reset control, since the voltage across each of the devices $E_{2,1}$ to $E_{3,n}$ is set to the same electric potential of $V_{cc}$, the charges stored in each of the devices $E_{2,1}$ and $E_{3,2}$ to $E_{3,n}$ are discharged along routes as shown by arrows in the diagram. The stored charges of those devices are instantaneously extinguished. The electric potential $V_{cc}$ is applied to the device $E_{1,1}$ in the backward direction and the device $E_{1,1}$ is charged to a polarity as shown in the diagram. The charging state of each of the devices $E_{4,2}$ to $E_{m,n}$ is continued.

After the resetting period as mentioned above, when the next horizontal scanning period is started, only the scan switch $\mathbf{15}_2$ corresponding to the cathode line $B_2$ is now switched to the 0V side as shown in FIG. 21 and the cathode line $B_2$ is scanned. At the same time, the drive switches $\mathbf{16}_2$ and $\mathbf{16}_3$ are switched to the side of the current sources $\mathbf{17}_2$ and $\mathbf{17}_3$ and connected to the corresponding anode lines. The other drive switches $\mathbf{16}_1$ and $\mathbf{16}_4$ to $\mathbf{16}_m$ are switched to the ground potential side and 0V is applied to the anode lines $A_1$ and $A_4$ to $A_m$. In the case of FIG. 21, therefore, only the devices $E_{2,2}$ and $E_{3,2}$ are biased in the forward direction. The driving current flows from the current sources $\mathbf{17}_2$ and $\mathbf{17}_3$ as shown by arrows and only the devices $E_{2,2}$ and $E_{3,2}$ perform the light emission. In the light emitting state, each of the non-light emitting devices $E_{1,1}$, $E_{1,3}$ to $E_{1,n}$, $E_{4,1}$ to $E_{m,1}$, and $E_{4,3}$ to $E_{m,n}$ shown by hatched capacitor symbols is charged to a polarity as shown in the diagram.

A length of the $B_1$ scanning period when the scan is shifted from the $B_1$ scanning period of the dimmer of 50% to the $B_2$ scanning period and a length of the resetting period in the case of using the driving method shown in FIGS. 19 to 21 are similar to those shown in FIG. 15. When shifting from the $B_1$ scanning period to the resetting period, the emission of the charges of ne and the charging of the charges of 2e in the device $E_{1,1}$ occur. In the $B_2$ scanning period, the discharge of the charges of (m−3)e and the charging of the charges of (m+n)e—3e are similarly performed. Now, assuming that m=4, for easy understanding, a discharge amount of the charges in the $B_2$ scanning period is equal to (n+1)e. That is, a whole amount of charges to be consumed is equal to 2(n+2)e by the operations of FIGS. 19 to 21 and an amount of charges to be consumed can be reduced as compared with that in the conventional reset driving method.

FIGS. 22 to 25 show further another embodiment of the invention. In the embodiment, a construction of a display apparatus is similar to that in the embodiment shown in FIGS. 10 and 12 to 14.

FIGS. 22 to 25 show operating states of the $B_1$ scanning period, resetting period, and $B_2$ scanning period in the case where the cathode line $B_1$ is scanned to thereby allow the devices $E_{1,1}$ and $E_{2,1}$ to perform the light emission by the control operation of the light emission control circuit 12 and, thereafter, the scan is shifted to the cathode line $B_2$ to thereby allow the devices $E_{2,2}$ and $E_{3,2}$ to perform the light emission, respectively. It is assumed that the luminance information obtained from the from the luminance operating unit 18 at the time shows the dimmer of 50% and, further, a gradation ratio of the devices $E_{1,1}$ and $E_{2,1}$ is equal to 1:½ in the dimmer of 50%. The operating states will now be described.

Figure 22:
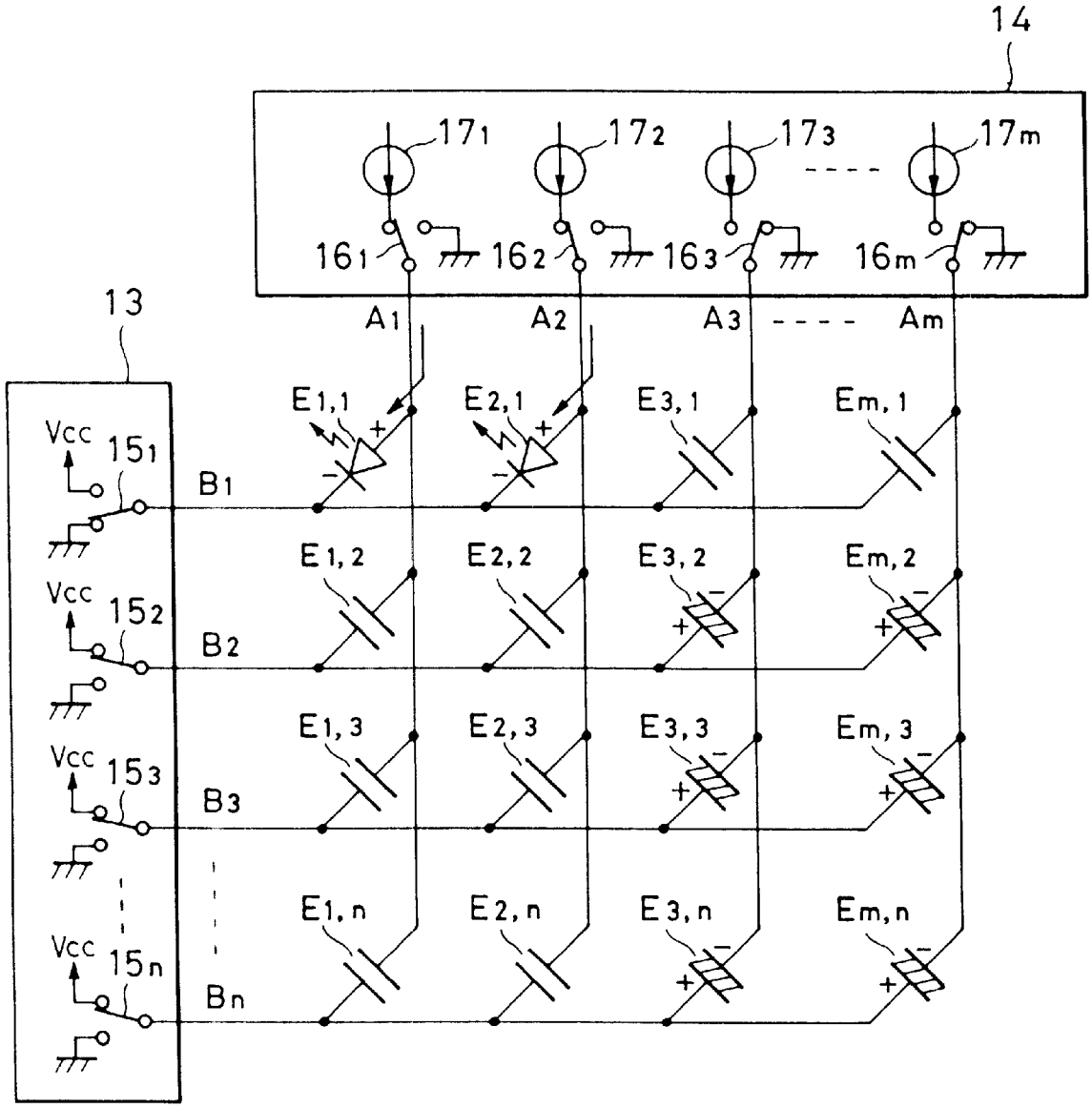
FIG. 22 is a block diagram for explaining a reset driving method which is applied to the display apparatus of FIG. 10.

First, in FIG. 22, only the scan switch $\mathbf{15}_1$ is switched to the ground potential side of 0V and the cathode line $B_1$ is scanned. The inverse bias potential $V_{cc}$ is applied to the other cathode lines $B_2$ to $B_n$ by the scan switches $\mathbf{15}_2$ to $\mathbf{15}_n$. At the same time, the current sources $\mathbf{17}_1$ and $\mathbf{17}_2$ are connected to the anode lines $A_1$ and $A_2$ by the drive switches $\mathbf{16}_1$ and $\mathbf{16}_2$. The other anode lines $A_3$ to $A_m$ are switched to the ground potential side of 0V by the drive switches $\mathbf{16}_3$ to $\mathbf{16}_m$. In the case of FIG. 22, therefore, only the devices $E_{1,1}$ and $E_{2,1}$ are biased in the forward direction, the driving current flows from the current sources $\mathbf{17}_1$ and $\mathbf{17}_2$ as shown by arrows, and only the devices $E_{1,1}$ and $E_{2,1}$ perform the light emission. In the light emitting state, each of the non-light emitting devices $E_{3,2}$ to $E_{m,n}$ shown by hatched capacitor symbols is charged to a polarity as shown in the diagram.

Figure 23:
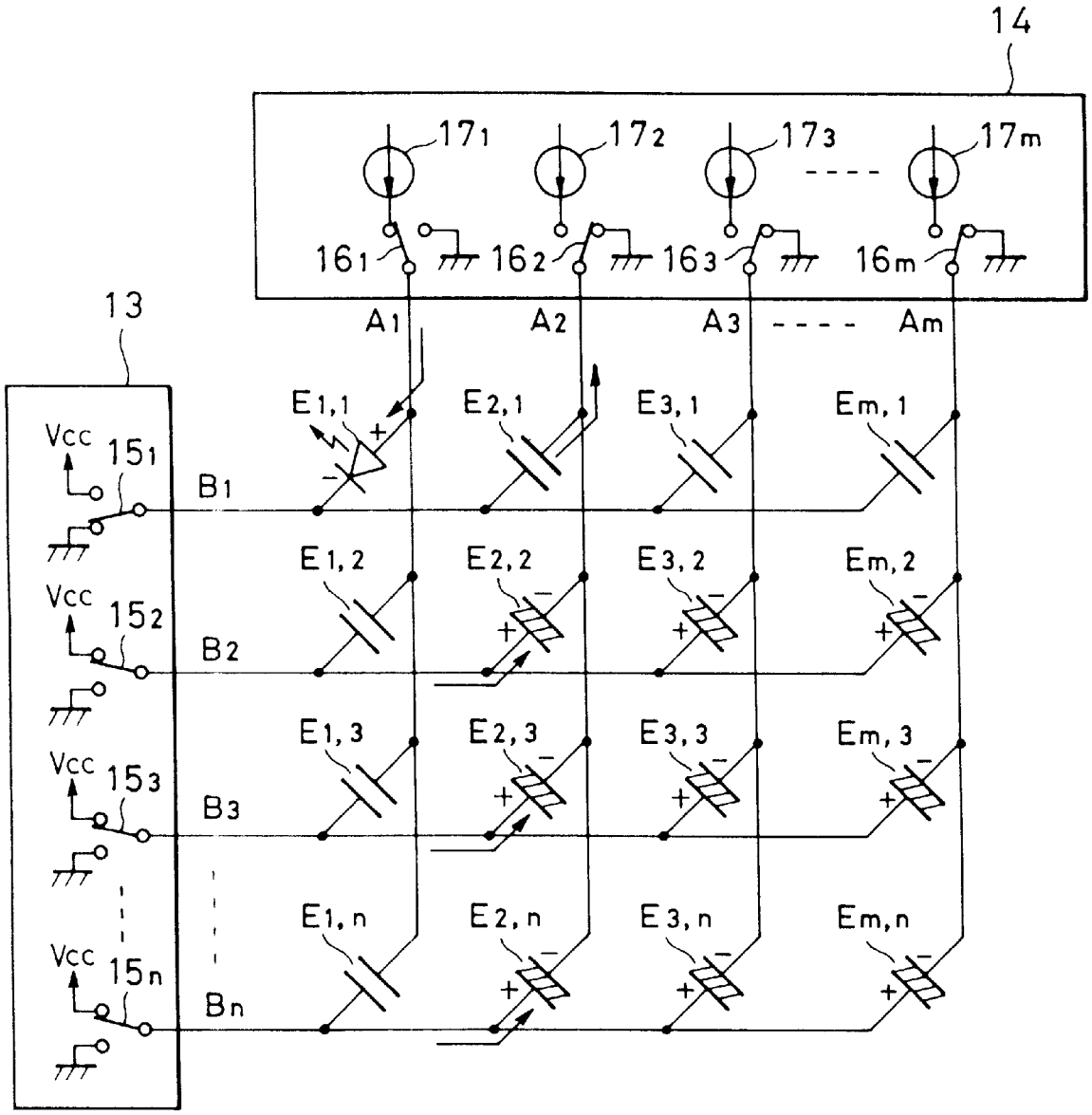
FIG. 23 is a block diagram for explaining a reset driving method which is applied to the display apparatus of FIG. 10.

When the time of a length of T/4 of the scanning period T elapses from the start of the light emission in FIG. 22, as shown in FIG. 23, the drive switch $\mathbf{16}_2$ is switched to the ground potential side and the switching state of the drive switch $\mathbf{16}_1$ is maintained. The scan of the cathode line $B_1$ is held. Since the voltage across the device $E_{2,1}$ is equal to the ground potential, therefore, the charges stored in the device $E_{2,1}$ are discharged along routes as shown by arrows in the diagram. Since the inverse bias potential $V_{cc}$ is applied to each of the devices $E_{2,2}$ to $E_{2,n}$, each of the devices $E_{2,2}$ to $E_{2,n}$ is charged to a polarity as shown in the diagram.

Figure 24:
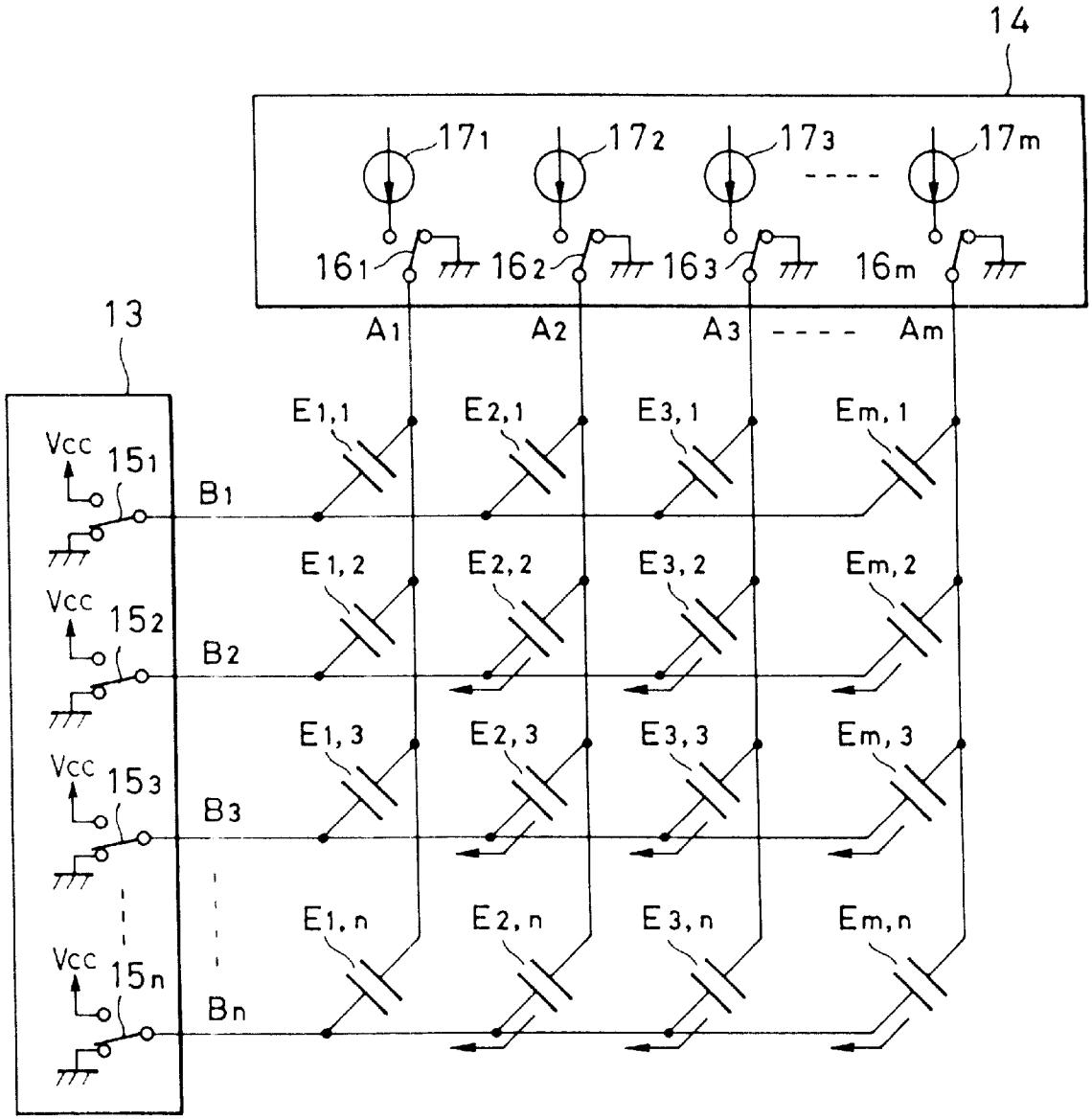
FIG. 24 is a block diagram for explaining a reset driving method which is applied to the display apparatus of FIG. 10.

When the light emitting state of FIG. 23 continues only for the time T/4, the reset control is performed. All of the drive switches $\mathbf{16}_1$ to $\mathbf{16}_m$ and the scan switches $\mathbf{15}_1$ to $\mathbf{15}_n$ are switched to the ground potential side of 0V as shown in FIG. 24 and all of the anode lines $A_1$ to $A_m$ and cathode lines $B_1$ to $B_n$ are set to the same ground potential of 0V. By the reset control, since all of the anode lines and cathode lines are set to the same electric potential of 0V, the charges stored in each device are discharged along routes as shown by arrows in the diagram. The stored charges of all of the devices are instantaneously extinguished.

Figure 25:
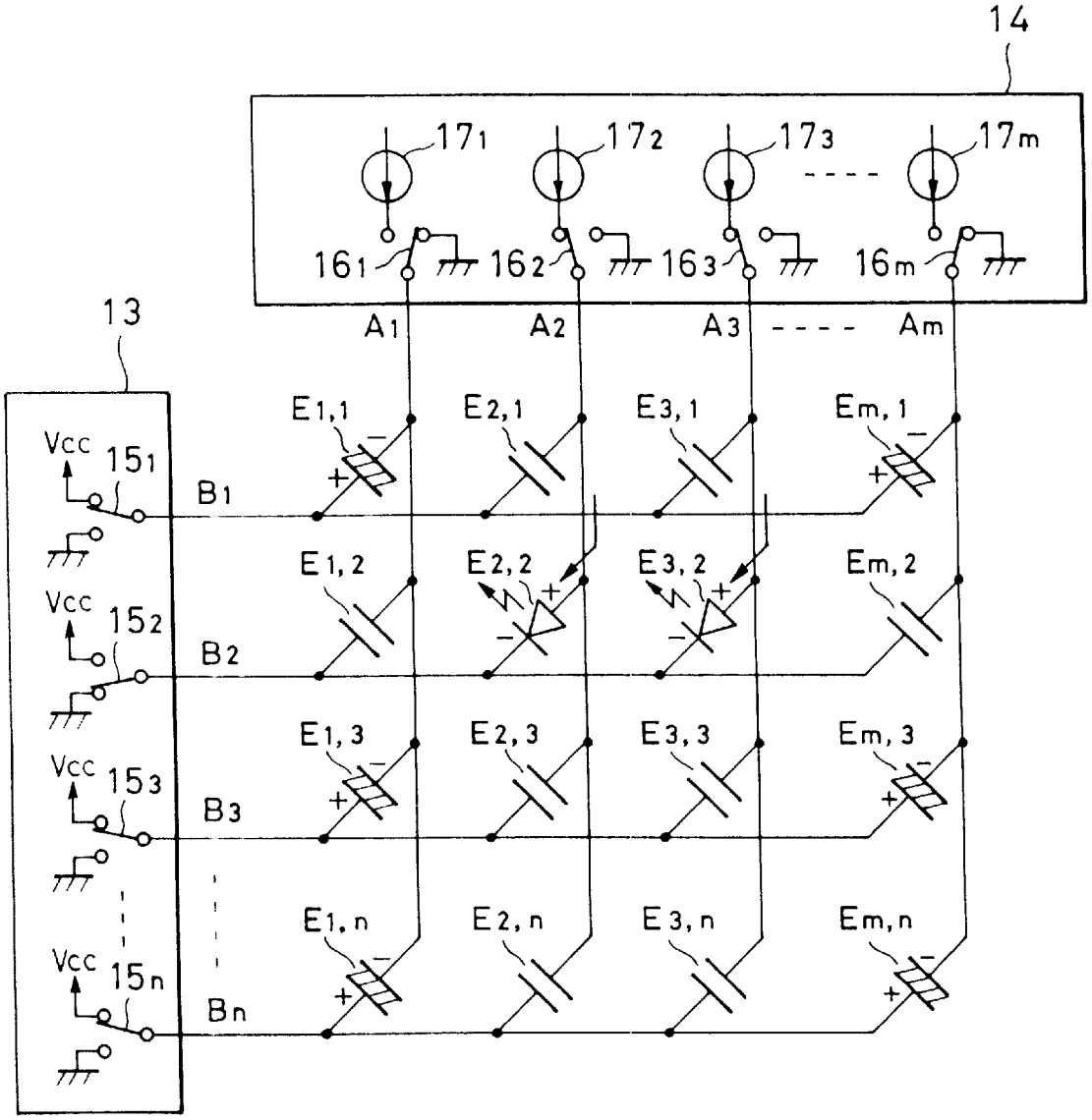
FIG. 25 is a block diagram for explaining a reset driving method which is applied to the display apparatus of FIG. 10.

After the stored charges of all devices are set to zero as mentioned above, when the next horizontal scanning period is started, only the scan switch $\mathbf{15}_2$ corresponding to the cathode line $B_2$ is now switched to the 0V side as shown in FIG. 25 and the cathode line $B_2$ is scanned. At the same time, the drive switches $\mathbf{16}_2$ and $\mathbf{16}_3$ are switched to the side of the current sources $\mathbf{17}_2$ and $\mathbf{17}_3$ and connected to the corresponding anode lines. The other drive switches $\mathbf{16}_1$ and $\mathbf{16}_4$ to $\mathbf{16}_m$ are switched to the ground potential side and held and 0V is applied to the anode lines $A_1$ and $A_4$ to $A_m$. In the case of FIG. 25, therefore, only the devices $E_{2,2}$ and $E_{3,2}$ are biased in the forward direction. The driving current flows from the current sources $\mathbf{17}_2$ and $\mathbf{17}_3$ as shown by arrows and only the devices $E_{2,2}$ and $E_{3,2}$ perform the light emission. In the light emitting state, each of the non-light emitting devices $E_{1,1}$, $E_{1,3}$ to $E_{1,n}$, $E_{4,1}$ to $E_{m,1}$, and $E_{4,3}$ to $E_{m,n}$ shown by hatched capacitor symbols is charged to a polarity as shown in the diagram.

Figure 26:
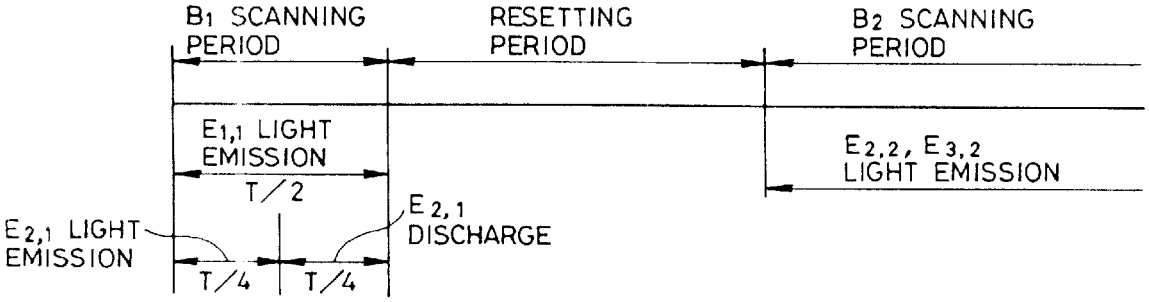
FIG. 26 is a diagram showing a timing chart of the reset driving methods shown in FIGS. 22 to 25.

In the $B_1$ scanning period of the dimmer of 50% in the case of using the driving method of FIGS. 22 to 25, as shown in FIG. 26, the light emitting operation for scanning the cathode line $B_1$ and allowing the devices $E_{1,1}$ and $E_{2,1}$ to perform the light emission is executed only for the former half driving time of T/4, and the light emitting operation for allowing only the device $E_{1,1}$ to perform the light emission is executed only for the latter half driving time of T/4. A gradation ratio of the devices $E_{1,1}$ and $E_{2,1}$ is, thus, equal to 1:½. In the next resetting period, as mentioned above, the voltages across all of the devices are set to the same ground potential. The resetting period is continued until the next $B_2$ scanning period is started. In the $B_2$ scanning period, the scan is shifted to the cathode line $B_2$ to thereby allow the devices $E_{2,2}$ and $E_{3,2}$ to perform the light emission. In the case, when the operation is shifted to the latter half light emitting operation of only the device $E_{1,1}$ in the $B_1$ scanning period, the emission of the charges of e and the charging of the charges of (n−1)e occur. When shifting from the $B_1$ scanning period to the resetting period, the emission of the charges of (m−1)(n−1)e+e occurs. In the $B_2$ scanning period, the charging of the charges of [2+(m−2)(n−1)]e is similarly performed. Now, assuming that m=4, an emission amount of the charges in the resetting period is equal to (3n−2)e and a charging amount of the charges in the $B_2$ scanning period is equal to 2ne. That is, a whole amount of charges to be consumed is equal to (6n−3)e by the operations of FIGS. 22 to 25 and an amount of charges to be consumed can be reduced as compared with that in the conventional reset driving method.

Although each of the embodiments has been described with respect to the dimmer of 50%, even in the case of the intermediate luminance in which the percentage of the dimmer is equal to a value other than 50%, an amount of charges to be consumed can be reduced by the operations similar to those mentioned above.

The electric potentials which are applied to the driving lines and scanning lines are not limited to the ground potential and bias potential $V_{cc}$.

Further, although the embodiment has been constructed in a manner such that the luminance information is derived from the luminance operating unit 18, the luminance information of every pixel shown by the input image data can be also obtained and used.

According to the invention as described above, the electric power consumption can be reduced in the case of the gradation display and the intermediate luminance as compared with that in the reset driving method of the conventional simple matrix display panel.

What is claimed is:

1. A driving method of a simple matrix display panel having a plurality of driving lines, a plurality of scanning lines and a plurality of capacitive light emitting devices connected between said scanning lines and said driving lines at a plurality of crossing positions by said driving lines and said scanning lines, comprising the steps of:

selecting some of said plurality of driving lines for a scanning period in a predetermined cyclic period consisting of the scanning period and a resetting period subsequent thereto, selecting one of said plurality of scanning lines in order, connecting current sources to the selected driving lines, and supplying a current in the forward direction to each of the capacitive light emitting devices between said selected driving lines and said selected one scanning line; and in said resetting period, applying a same electric potential to driving lines to be selected for at least a next scanning period and all of said plurality of scanning lines, thereby discharging charges of the capacitive light emitting devices between the driving lines to be selected and all of the scanning lines, wherein a length of the scanning period in said predetermined cyclic period is changed in response to a luminance information command indicative of a display luminance, and the period other than the scanning period in said predetermined cyclic period is set to said resetting period.

2. A method according to claim 1, wherein in said resetting period, a ground potential is applied to all of said plurality of driving lines and all of said plurality of scanning lines.

3. A method according to claim 1, wherein in said resetting period, a same electric potential as a specified light emission voltage of said capacitive light emitting device is applied to the selected driving lines for the present scanning period, the driving lines to be selected for the next scanning period and all of said plurality of scanning lines, and a ground potential is applied to the driving lines other than both of the selected driving lines for the present scanning period and the driving lines to be selected for the next scanning period.

4. A method according to claim 1, wherein in said resetting period, a same electric potential as a specified light emission voltage of said capacitive light emitting device is applied to the selected driving lines for a next scanning period and all of said plurality of scanning lines, and a ground potential is applied to the driving lines other than the driving lines to be selected for said next scanning period.

5. A method according to claim 1, wherein a length of said scanning period is changed for each of the present selected driving lines, and a period is shifted to said resetting period after the end of a longest one of the different scanning periods.

6. A method according to claim 1, wherein each of said capacitive light emitting devices is an organic electroluminescence device.

7. A display apparatus comprising:

a simple matrix display panel having a plurality of driving lines, a plurality of scanning lines, and a plurality of capacitive light emitting devices connected between said scanning lines and said driving lines at a plurality of crossing positions by said driving lines and said scanning lines;

scanning period control means for selecting some of said plurality of driving lines in a scanning period in predetermined cyclic period consisting of the scanning period and a resetting period subsequent thereto, selecting one of said plurality of scanning lines in order, connecting current sources to the selected driving lines, and supplying a current in the forward direction to each of the capacitive light emitting devices between said selected driving lines and said selected one scanning line; and resetting period control means for applying a same electric potential to driving lines to be selected for at least a next scanning period and all of said plurality of scanning lines in said resetting period, thereby discharging charges of the capacitive light emitting devices between the driving lines to be selected and all of said scanning lines, wherein a length of the scanning period in said predetermined cyclic period is changed in response to a luminance information command indicative of a display luminance, and the period other than the scanning period in said predetermined cyclic period is set to said resetting period.

* * * * *